US010252118B2

(12) United States Patent
Krysiak et al.

(10) Patent No.: US 10,252,118 B2
(45) Date of Patent: Apr. 9, 2019

(54) BASKETBALL WITH ELECTRONICS

(71) Applicant: Wilson Sporting Goods Co., Chicago, IL (US)

(72) Inventors: Kevin Krysiak, Palatine, IL (US); Robert Thurman, Plainfield, IL (US); Rayna Kearney, Lombard, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 17 days.

(21) Appl. No.: 14/946,399

(22) Filed: Nov. 19, 2015

(65) Prior Publication Data

US 2016/0074714 A1 Mar. 17, 2016

Related U.S. Application Data

(63) Continuation-in-part of application No. 14/212,932, filed on Mar. 14, 2014, which is a continuation-in-part of application No. 14/071,384, filed on Nov. 4, 2013, now Pat. No. 9,656,140.

(60) Provisional application No. 61/891,487, filed on Oct. 16, 2013, provisional application No. 61/799,851, filed on Mar. 15, 2013, provisional application No. 61/800,972, filed on Mar. 15, 2013, provisional (Continued)

(51) Int. Cl.

| | |
|---|---|
| ***A63B 45/00*** | (2006.01) |
| ***A63B 41/00*** | (2006.01) |
| ***A63B 41/08*** | (2006.01) |
| ***A63B 43/00*** | (2006.01) |
| ***A63B 43/06*** | (2006.01) |
| *A63B 45/02* | (2006.01) |
| *A63B 67/00* | (2006.01) |

(52) U.S. Cl.

CPC ..... *A63B 45/00* (2013.01); *A63B 41/00* (2013.01); *A63B 41/08* (2013.01); *A63B 43/00* (2013.01); *A63B 43/06* (2013.01); *A63B 45/02* (2013.01); *A63B 67/002* (2013.01); *A63B 2041/005* (2013.01); *A63B 2208/12* (2013.01); *A63B 2220/12* (2013.01); *A63B 2220/30* (2013.01); *A63B 2220/35* (2013.01); *A63B 2220/40* (2013.01); *A63B 2220/56* (2013.01); *A63B 2220/72* (2013.01); *A63B 2225/20* (2013.01); *A63B 2225/50* (2013.01); *A63B 2225/54* (2013.01); *A63B 2243/0037* (2013.01)

(58) Field of Classification Search

CPC ... A63B 67/002; A63B 2208/12; A63B 45/00; A63B 45/02; A63B 43/00; A63B 41/00; A63B 2041/005; A63B 2225/50; A63B 2225/54

USPC ..... 473/415

See application file for complete search history.

(56) References Cited

U.S. PATENT DOCUMENTS 2,903,820 A 9/1959 Bodell
2,995,311 A * 8/1961 Holman ..... B29D 22/04 156/170

(Continued)

FOREIGN PATENT DOCUMENTS

WO WO2014/008202 A1 * 1/2014 ..... A63B 69/0071

*Primary Examiner* — William H McCulloch, Jr.
*Assistant Examiner* — Chase E Leichliter
(74) *Attorney, Agent, or Firm* — Terence P. O'Brien; Todd A. Rathe

(57) ABSTRACT

A basketball includes a bladder, electronics within the bladder proximate an outer portion of the bladder, windings about the bladder, and a molded elastomeric layer about the bladder and extending over the electronics.

25 Claims, 15 Drawing Sheets

Related U.S. Application Data application No. 61/788,304, filed on Mar. 15, 2013, provisional application No. 61/798,738, filed on Mar. 15, 2013, provisional application No. 61/724,668, filed on Nov. 9, 2012.

(56) References Cited

U.S. PATENT DOCUMENTS 3,011,048 A 11/1961 O'Brien
3,229,976 A 1/1966 Allen
3,458,205 A 7/1969 Smith et al.
3,580,575 A 5/1971 Speeth
3,610,916 A 10/1971 Meehan
4,002,893 A 1/1977 Newcomb
4,133,528 A 1/1979 Koblick
4,479,649 A 10/1984 Newcomb
4,701,146 A 10/1987 Swenson
4,776,589 A 10/1988 Yang
4,963,117 A 10/1990 Gualdoni
5,080,359 A 1/1992 Thill
5,102,131 A 4/1992 Remington
5,186,458 A 2/1993 Redondo
5,403,000 A 4/1995 Woosley
5,564,702 A 10/1996 Meffert
5,609,411 A 3/1997 Wang
5,639,076 A 6/1997 Cmiel et al.
5,683,316 A 11/1997 Campbell
5,725,445 A 3/1998 Kennedy et al.
5,776,018 A * 7/1998 Simpson ..... A63B 24/0021 473/433
5,883,569 A * 3/1999 Kolefas ..... A43B 3/00 273/372
5,888,156 A 3/1999 Cmiel et al.
6,251,035 B1 6/2001 Fa
6,389,368 B1 * 5/2002 Hampton ..... A63B 24/0021 473/479
6,428,432 B1 8/2002 Kachel
6,726,580 B2 4/2004 Peterson
7,179,181 B2 2/2007 Ko
7,273,431 B2 9/2007 DeVall
7,740,551 B2 6/2010 Nurnberg et al.
8,231,487 B2 7/2012 Nurnberg et al.
8,289,185 B2 10/2012 Alonso
8,477,046 B2 7/2013 Alonso
8,535,185 B2 9/2013 Englert
8,672,782 B2 3/2014 Homsi et al.
8,758,172 B2 6/2014 Creguer
9,079,090 B2 7/2015 Hohteri
9,265,991 B2 2/2016 Hohteri
2003/0054905 A1 3/2003 King
2005/0288133 A1 12/2005 Rudell
2005/0288134 A1 12/2005 Smith
2006/0063622 A1 * 3/2006 Nurnberg ..... A63B 41/02 473/604
2007/0091084 A1 4/2007 Ueshima et al.
2008/0254866 A1 * 10/2008 Young ..... A63B 24/0021 463/25
2008/0312010 A1 * 12/2008 Marty ..... A63B 24/0003 473/447
2009/0029754 A1 * 1/2009 Slocum ..... A63B 24/0087 463/5
2009/0111616 A1 4/2009 Creelman
2009/0189982 A1 * 7/2009 Tawiah ..... A63B 24/0006 348/157
2009/0325739 A1 12/2009 Gold
2010/0050082 A1 * 2/2010 Katz ..... H04N 5/272 715/719
2010/0069181 A1 3/2010 Lin
2010/0113189 A1 * 5/2010 Blair ..... A63B 63/083 473/433
2010/0130314 A1 * 5/2010 Von Der Gruen ..... A63B 63/00 473/570
2010/0130315 A1 * 5/2010 Steidle ..... A63B 41/02 473/570
2010/0211198 A1 * 8/2010 Ressler ..... G06Q 30/00 700/91
2011/0013087 A1 * 1/2011 House ..... A63B 24/0021 348/564
2011/0118062 A1 5/2011 Krysiak et al.
2011/0118064 A1 5/2011 Krysiak et al.
2011/0118065 A1 5/2011 Krysiak et al.
2011/0212798 A1 9/2011 Zawitz
2011/0218065 A1 * 9/2011 Cavallaro ..... A63B 41/00 473/603
2011/0304497 A1 * 12/2011 Molyneux ..... A43B 1/0054 342/42
2011/0316529 A1 12/2011 Stancil et al.
2012/0040785 A1 2/2012 De Sort
2012/0058845 A1 * 3/2012 Crowley ..... A63B 41/00 473/604
2012/0071282 A1 3/2012 Smith
2012/0169585 A1 7/2012 Albano et al.
2012/0172129 A1 7/2012 Vaananen
2012/0212505 A1 * 8/2012 Burroughs ..... G06F 19/3481 345/629
2012/0244969 A1 * 9/2012 Binder ..... A63H 33/18 473/570
2012/0322587 A1 * 12/2012 Duke ..... A63B 69/0071 473/450
2013/0274040 A1 * 10/2013 Coza ..... G09B 19/0038 473/570
2013/0274635 A1 * 10/2013 Coza ..... G06F 19/3481 600/595
2014/0243122 A1 * 8/2014 Crowley ..... A63B 43/06 473/570
2014/0256478 A1 9/2014 Gale
2014/0309058 A1 10/2014 San Juan
2015/0157900 A1 * 6/2015 Holthouse ..... A63B 24/0021 473/570
2015/0382076 A1 * 12/2015 Davisson ..... H04H 20/04 725/62
2016/0001136 A1 * 1/2016 King ..... A63B 69/0071 320/108

* cited by examiner

BASKETBALL WITH ELECTRONICS

CROSS-REFERENCE TO RELATED PATENT APPLICATIONS

The present application is a continuation-in-part application claiming priority under 35 U.S.C. Section 120 from of co-pending U.S. patent application Ser. No. 14/212,932 filed on Mar. 14, 2014 by Thurman et al. and entitled BASKETBALL ELECTRONICS SUPPORT, the full disclosure of which is hereby incorporated by reference, which is a continuation in part of application Ser. No. 14/071,384 filed on Nov. 4, 2013, which claims priority to provisional application No. 61/724,668 filed on Nov. 9, 2012, provisional application No. 61/798,738, filed on Mar. 15, 2013, provisional application No. 61/788,304, filed on Mar. 15, 2013, provisional application No. 61/799,851, filed on Mar. 15, 2013, provisional application No. 61/800,972 filed on Mar. 15, 2013, and provisional application No. 61/891,487 filed on Oct. 16, 2013.

BACKGROUND

During a game of basketball, the basketball is repeatedly bounced, such as when the basketball is being dribbled, or such as when the basketball being bounce-passed. It is essential that the bounce characteristics of the basketball be substantially consistent and uniform, regardless of what portion of the basketball is being bounced against another surface.

BRIEF DESCRIPTION OF THE DRAWINGS

FIGS. 12-15 are perspective views illustrating one example method for forming of a preliminary inflatable body for a bladder for any of the basketballs of FIGS. 1, 6-9, 10 and 11. FIG. 12 is a perspective view illustrating the forming of apertures through a panel for forming the preliminary inflatable body.

FIG. 15 is a perspective view of the preliminary inflatable body after portions of the panel exterior to the fuse lines of FIG. 14 have been trimmed.

DETAILED DESCRIPTION OF EXAMPLES

FIGS. 1-4 illustrate an example basketball 10 that includes electronics. As will be described hereafter, basketball 10 is formed and is configured such that the inclusion of the electronics and the manner by which the electronics are supported have a reduced impact upon the bounce characteristics of basketball 10. As a result, basketball 10 exhibits more consistent bounce characteristics regardless of what specific portion of the basketball is undergoing impact.

Figure 1:
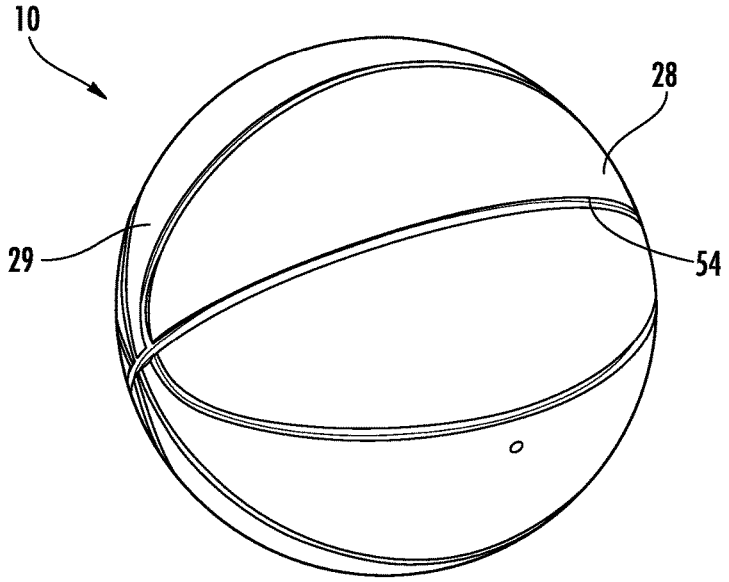
FIG. 1 is a perspective view of an example basketball having internal electronics and enhanced bounce consistency.
Figure 2:
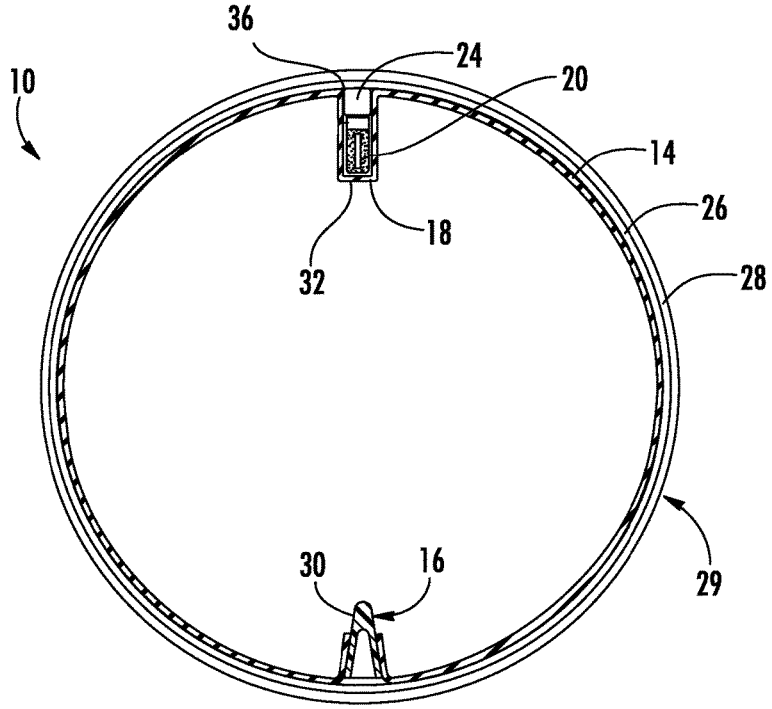
FIG. 2 is a sectional view of the basketball of FIG. 1.
Figure 3:
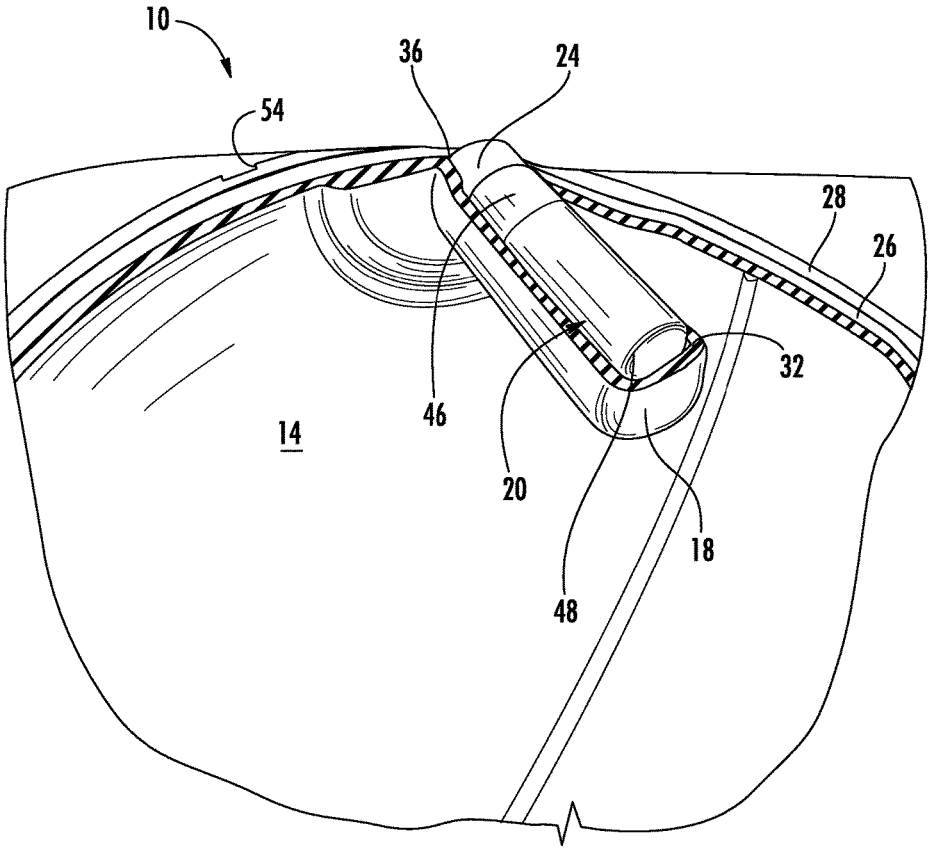
FIG. 3 is an enlarged fragmentary sectional view of the basketball of FIG. 1.
Figure 4:
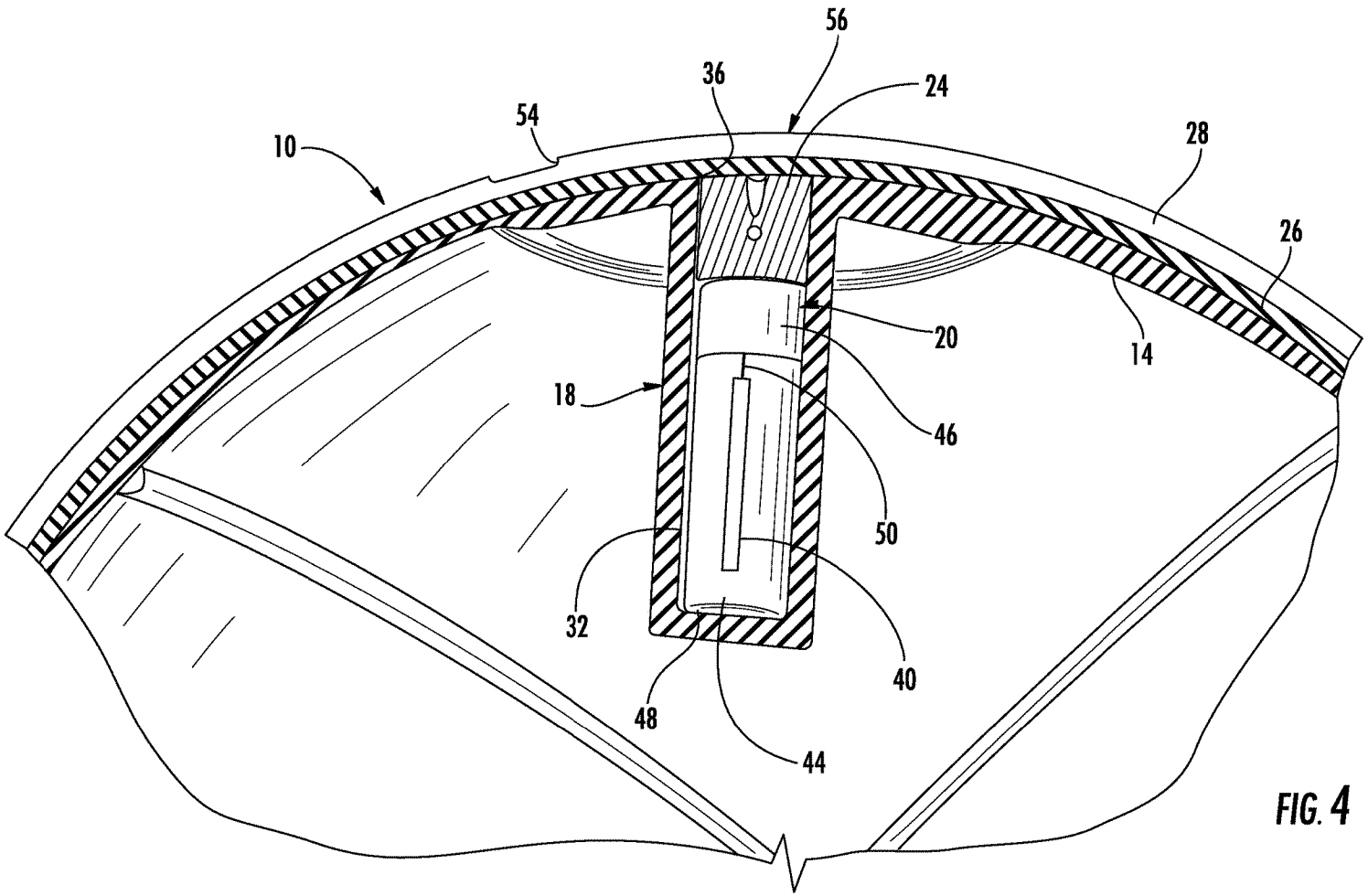
FIG. 4 is an enlarged fragmentary sectional view of the basketball of FIG. 1.

FIGS. 2-4 are sectional views of basketball 10. As shown by such figures, basketball 10 is a generally spherical inflatable object. Basketball 10 includes a carcass 29. Carcass 29 is a combination of ball components that are molded in a carcass-forming mold to produce an inflatable ball structure. In one implementation, carcass 29 includes a bladder 14, a layer of windings 26 and at least one elastomeric layer 28 of elastomeric material. In one implementation, as shown in FIGS. 1-4, the elastomeric layer 28 can be used as the cover layer of the basketball 10, such that the outer surface of the elastomeric layer 28 also forms the outer surface of the basketball 10. Basketball 10 further comprises valve 16, receptacle 18, electronics insert 20, and plug 24. Bladder 14 comprises an inflatable body or an inflatable sphere formed from materials such as butyl rubber, natural rubber, a combination of butyl and natural rubber and other elastic materials. In one implementation, bladder 14 is made from 80% butyl rubber and 20% natural rubber. In other implementations, the bladder 14 can be formed of latex, or other combinations of butyl rubber and natural rubber. Bladder 14 enables the basketball 10 to retain a predetermined amount of air thereby achieving the desired air pressure within, or firmness to, the basketball 10.

Valve 16 facilitates inflation of bladder 14. Valve 16 is secured to the exterior of bladder 14 and comprises an inflation tube 30 that extends through bladder 14, windings 26, and the elastomeric layer 28. Valve 16 is configured to allow air to enter the bladder 14 through use of an inflation needle (not shown) and, when removed, retain the air within the bladder 14.

FIGS. 3 and 4 illustrate receptacle 18 and electronics insert 20 in more detail. As shown by FIGS. 3 and 4, receptacle 18, sometimes also referred to as an enclosure or housing, extends into bladder 14 (shown in an at least partially inflated state) and forms a cavity 32 for receiving electronics insert 20. In one implementation, receptacle 18 comprises a distinct member from bladder 14 which is treated, such as by being vulcanized, so as to fuse or join to the material of bladder 14. In yet other implementations, receptacle 18 is integrally formed as a single unitary body with the remainder of bladder 14. In yet another implementation, receptacle 14 comprises a separate component welded, fused, stitched, bonded, adhered to or fastened to a remainder of bladder 14 in other fashions.

In the example illustrated, receptacle 18 is formed from a flexible and resiliently stretchable material. In one implementation, is formed from the same material as bladder 14. In other implementations, receptacle 18 may be formed from other flexible resiliently flexible materials. As a result, upon being inflated to a recommended pressure for use of basketball 10, receptacle 18 squeezes about electronics insert 20 and plug 24 to assist in securing electronics insert 20 and possibly plug 24 in place. In yet other implementations, receptacle 18 may alternatively be formed from a rigid or inflexible material such that receptacle 18 does not change in shape, dimension or proportion in response to inflation of bladder 14. In other implementations, the receptacle 18 can be formed of compositions of materials that provide varying levels of flexibility, resiliency, or rigidity. The specific composition can be adjusted to match the characteristics of the insert (e.g. the weight, size, and position of the insert 20) to provide the most accurate transmission of signals from the electronics 40. In one implementation, a lubricant can be used between the receptacle 18 and the insert 20. The lubricant can be used to facilitate independent movement of the insert 20 and the receptacle 18 during use, if desired. The lubricant can also be used to facilitate the insertion of the insert 20 within the receptacle 18. In other implementations, the lubricant can be omitted.

In the example illustrated, receptacle 18 extends partially into the interior of bladder 314. In the example illustrated, receptacle 18 is located directly opposite to the valve 16 and inflation tube 30. As a result, receptacle 18 offsets the opposite weight of valve 16 and inflation tube 30. In one implementation, receptacle 18, electronics insert 20 and plug 24 have a weight substantially matching the weight of valve 16 and inflation tube 30 to provide balance to ball 14. In other implementations, receptacle 18 as well as the contained electronics insert 20 and plug 24 are formed so as to project into the interior of bladder 14 at other locations relative to valve 16 and inflation tube 30.

Electronics insert 20 comprises a single body, member or unit inserted through mouth 36 of receptacle 18 into cavity 32 where insert 20 is retained. As shown by FIG. 4, insert 20 comprises electronics 40, potting compound 44 and the battery 46. Electronics 40 comprises one or more electronic components to carry out the sensing of one or more characteristics associated with basketball 10 and to carry out one or more of the transmission, storage and/or analysis of data resulting from the sensed characteristics. In one implementation, electronics 40 comprises an electronic chip. In the example illustrated, electronics 40 transmits one or more electronic signals which indicate the location, movement, speed, acceleration, deceleration, rotation, internal pressure, and/or temperature of basketball 10. Alternatively, electronics 40 comprises a passive circuit that allows the detection of the location, movement, speed, acceleration, deceleration, rotation and/or temperature of basketball 10 to be ascertained when subjected to a magnetic field or other sensing system. In one implementation, electronics comprises a circuit board supporting one or more sensors to sense the location, movement, speed, acceleration, deceleration and/or rotation of basketball 10. In one implementation, the circuit board can be a thin flexible member that can be attached to the bladder without the receptacle 18 or within the receptacle 18.

Potting compound 44 comprises a mass of solid compound at least substantially encapsulating, if not completely encapsulating, electronics 40. For purposes of this disclosure, the term "encapsulate" or "encapsulating" refers to a body or mass of material that contacts and closely conforms to the shape of the item being encapsulated which occurs as a result of the mass of material by being applied to the item being encapsulated while in a liquid, amorphous or gelatinous form, where the mass subsequently solidifies while about and against the item being encapsulated. The term "substantially encapsulate" or "substantially encapsulating" refers to the mass of material about and in close conformal contact with at least three sides of the item being encapsulated. The term "completely encapsulate" or "completely encapsulating" refers to the mass of material surrounding and enclosing on all sides the item being encapsulated.

In one implementation, potting compound 44 comprises a solidified mass of previously amorphous, gelatinous or liquid material. In one implementation, potting compound 44 comprises a polyurethane, silicone or other solidified polymer. In one implementation, potting compound 44 comprises a thermosetting plastic or silicone rubber gel. In one implementation, potting compound 44 comprises a low glass transition temperature potting compound to inhibit breakage of solder bonds during solidification.

Potting compound 44, when solidified or hardened, forms an encapsulating body 48 encapsulating electronics 40. Encapsulating body 48 is sized and shaped to fit within cavity 32 of receptacle 18. In the example illustrated, encapsulating body 48 has an outer profile or shape that substantially matches the outer profile or shape of cavity 32 so as to restrict or limit movement of body 48 within cavity 32. In the example illustrated in which cavity 32 is cylindrical, body 48 is also cylindrical. In other implementations, encapsulating body 48 may have other shapes when cavity 32 also has the same other corresponding shapes. For example, in one implementation, rather than comprising a cylinder having a circular cross-section, cavity 32 may alternatively comprise a cylinder having an oval cross-section or a polygonal cross-section. In yet another implementation, cavity 32 can be spherical or oblong. In still other implementations, cavity 32 may have other shapes. In still other implementations, encapsulating body 48 has other shapes or configurations, not necessarily matching the internal shape of cavity 32. In yet other implementations, an external surface of encapsulating body 48 may have one of a projection or detent, wherein the internal surface of cavity 32 has the other of the projection or detent. In such an implementation, at least one of the projection and detent resiliently flex to allow the projection to be snapped into the detent to facilitate securement and retention of body 48 and insert 20 within cavity 32 of receptacle 18.

In the example illustrated, potting compound 44 completely encapsulates electronics 40 but for one or more electrical conductors 50, in the form of electrical filaments, wires or traces extending from electronics 40 extending within and through potting compound 44 from within body 48 out of body 48. In the example illustrated, potting compound 44 solidifies while against and in contact with the electrical conductors 50 to seal against and about electrical conductors 50. In other implementations, a bore or other path is formed through body 48 for the passage of electrical conductors 50. Electrical conductors 50 facilitate electrical connection of electronics 40 to battery 46. In an alternative implementation, the electronics insert 20 can be formed without the potting compound 44. The electronics 40 can be coupled to one or more components of the ball such that the receptacle 18 is not used. In another alternative implementation, the electronics 40 can be inserted into the receptacle without the use of potting material. The receptacle can be sized to receive the electronics 40. The electronics 40 be inserted into a receptacle in a press-fit arrangement. In another implementation, the receptacle 18 can be configured to readily receive the electronics, then upon inflation the receptacle can be drawn tightly about the electronics.

Battery 46 comprises a source of power for electronics 40. Battery 46 extends external to body 48 at one axial end of body 48. In one implementation, battery 46 has an end portion encapsulated by potting compound 44 so as to be joined to body 48. In another implementation, battery 46 is welded, fused, bonded, adhered, fastened, retained or otherwise joined to an external surface of body 48. As will be described hereafter, in yet other implementations, battery 46 is completely encapsulated by potting compound 44 within body 48, but for any electrical conductors extending from battery 46 to locations external of body 48. In still other implementations, battery 46 may be independent of insert 20, not fixedly or connected to body 48 so as to be carried as a single unit with body 48. For example, in other implementations, battery 46 may have an electrical terminal or contact in electrical connection with an external electrical terminal or contact of body 48.

In one implementation, battery 46 is a non-rechargeable battery. In yet another implementation, battery 46 is rechargeable. In one implementation, battery 46 is rechargeable via a charging port extending through plug 24 into contact with a charging contact or terminal of battery 46. In yet another implementation, battery 46 is configured for wireless or inductive charging. In another implementation, battery 46 may be charged through one or more of bladder 14, windings 26 and the layer of elastomeric material 28.

Plug 24 comprises a member received within cavity 32 between insert 20 and an exterior of basketball 10. Plug 24 assists in protecting insert 20. In the example illustrated, plug 24 is formed from a resiliently compressible material, such as a foam or a rubber, absorbing impacts of basketball 10. In one implementation, plug 24 further provides an additional seal inhibiting the intrusion of moisture or other contaminants into the interior of cavity 32. In yet other implementations, plug 24 may other sizes, shapes or configurations and may be formed from incompressible materials. For example, in other implementations, plug 24 may comprise a flat panel or a three-dimensional panel serving as a cover or flap over cavity 32 between cavity 32 and one or more of windings 26 and/or cover layer 28. In another implementation, receptacle 18 and electronics insert 20 of basketball 10 can be formed without a plug.

Windings 26 comprise a layer of wound reinforcing thread wound about or over bladder 14. In one implementation, prior to the application of cover layer 28, the reinforcing thread may be further coated or covered with a viscous material, such as a latex or adhesive. In one implementation, the reinforcing thread is passed through a viscous adhesive material prior to being wound about bladder 14. In one implementation, the thread forming windings 26 are formed of a high tensile strength material, such as nylon 66. In other implementations, the thread are material forming windings 26 may comprise other materials, such as a polyurethane, other elastomeric materials, and nylon/urethane combinations. In one implementation, windings 26 can be comprised of 2100 meters of 210 denier Nylon thread. In some implementations, selected portions of the layer of windings 26 are translucent or transparent. The threads form windings 26 that reinforce bladder 14 and retain the generally spherical shape of bladder 14. In an alternative embodiment, the basketball can be formed without a layer of windings. In another alternative preferred embodiment, the layer of windings can be formed through one or more segments of adhesive tape, or similar material.

Elastomeric layer 28 comprises a layer of elastic material over and about windings 26. In one implementation, the elastomeric layer 28 comprises a natural rubber, a butyl rubber, a sponge rubber, a styrene-butadiene rubber (sbr), a foamed elastomeric material or a combination thereof as described in U.S. Pat. No. 5,681,233. In one implementation, elastomeric layer 28 is formed by laying panels or sheets of material over windings 26 and by molding or fusing the panels into a continuous integral unitary homogenous layer over windings 26. In another implementation, elastomeric layer 28 is formed by injection molding or other fabrication techniques. It is common for a portion of the elastomeric material of the elastomeric layer 28 to impregnate, bond to, or otherwise engage the layer of windings 26. In one implementation, the material of the elastomeric layer 28 is a sponge rubber. As shown by FIGS. 3 and 4, in one implementation, during the formation of elastomeric layer 28 by molding or melting, the exterior surface of elastomeric layer 28 is molded or shaped to include valleys 54 or channels defined by inner edges of elastomeric layer 28. In one implementation in which elastomeric layer 28 also serves as the exterior surface or cover of basketball 10, the valleys 54 forming cover layer 28 provide grooves on the exterior of basketball 10 to facilitate gripping. In such an implementation where elastomeric layer 28 serves as the exterior surface basketball 10, the exterior service of cover layer 28 may additionally have molded thereon outwardly projecting pebbles between valleys 54. In some implementations, as we described hereafter, the basketball may include additional outer cover panels, wherein the basketball 10 shown in FIG. 2 may also be referred to as a carcass and wherein the elastomeric layer 28 is the outer surface of the carcass. In another implementation, elastomeric layer 28 can be a multi-layered body including one or more layers of fabric or elastomeric material.

As shown by FIGS. 2-4, windings 26 and elastomeric layer 28 continuously extends about bladder 14 and about basketball 10, extending completely across mouth 36 of receptacle 18 and completely across electronics insert 20 which lies directly below windings 26 and cover layer 28. In contrast to a distinct cap or cover along the outer surface of the basketball 10, windings 26 and cover layer 28 provide enhanced consistency and uniformity over mouth 36 and over electronics insert 20. Because windings 26 and elastomeric layer 28 continuously extend about basketball 10 while the same time continuously extending across electronics insert 20, basketball 10 exhibits more consistent and uniform bounce performance or bounce characteristics, and more consistent deflection characteristics, across its entire outer circumferential surface when different portions of the outer circumferential surface are undergoing impact. In particular, the bounce characteristics or rebound characteristics of basketball 10, when the exterior circumferential portion 56 of basketball 10 is directly impacting another surface, such as a basketball court, a blacktop, a floor, a backboard or a rim, will be closer to the bounce characteristics or rebound characteristics of basketball 10 when other exterior circumferential portions of basketball 10, such as portions proximate valve 16, portions adjacent to logo or other exterior circumvention portions, are directly impacting the same surface.

Figure 5A:
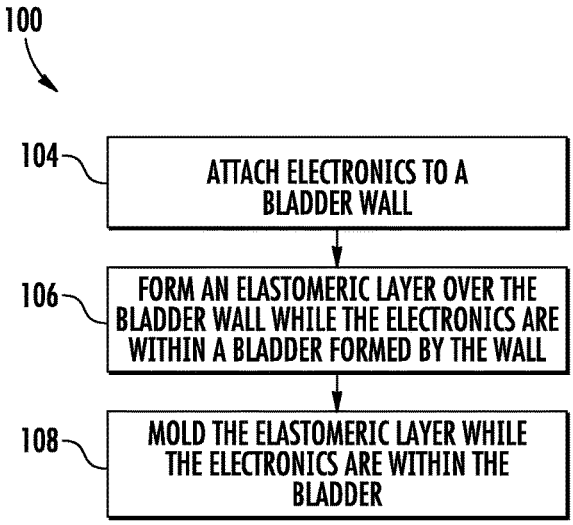
FIG. 5A is a flow diagram of an example method for forming the basketball of FIG. 1.

FIG. 5A is a flow diagram of an example method 100 for forming a basketball, such as basketball 10 described above. As indicated by block 104, electronics, such as electronics 40, are attached to a bladder wall. In one implementation, the bladder wall comprises a generally flat panel which is subsequently joined to other panels to form a generally spherical unmolded bladder, wherein the electronics are attached to the flat bladder wall prior to the panel being joined to the other panels to form the spherical unmolded bladder. In another implementation, the bladder wall comprises a generally flat panel that is folded with respect to itself, wherein overlapping adjacent portions are fused along lines to form seams of an unmolded generally spherical bladder and wherein the electronics are attached to a flat bladder wall prior to the flat panel being folded with respect to itself or prior to the flat panel being fused along seam lines to form the seams. In another implementation, electronics are attached to the panel after the panel has been folded relative to itself and after the flat-panel has been fused along seam lines to form the seams, but prior to inflation of the fused bladder panel. In another implementation, the bladder wall comprises the curved wall of an unmolded, generally spherical, at least partially inflated bladder (such as after the flat-panel described above has been fused along seam lines to form the seams and after the thus formed unmolded bladder has been at least partially inflated to form the unmolded generally spherical bladder), wherein electronics are attached to the bladder wall while the bladder wall is already part of the unmolded generally spherical bladder. In yet another implementation, the bladder wall comprises the curved wall of a molded, generally spherical bladder, wherein electronics are attached to the bladder wall after the spherical unmolded bladder has been molded.

In one implementation, electronics are directly attached to the bladder wall. In yet another implementation, electronics are attached to the bladder wall by being positioned within a receptacle which is itself attached to the bladder wall. In one implementation, electronics are part of an insert which is inserted into the receptacle which is attached to the bladder wall. In such implementations, the electronics may be positioned within the receptacle, attached to the bladder wall, while the bladder wall is a generally flat panel and prior to the bladder wall being joined to other panels to form an unmolded bladder. In other implementations, the electronic media positioned in the receptacle, attached to the bladder wall, while the bladder wall is part of an unmolded spherical bladder (after the panels have been joined to form the unmolded spherical bladder). In yet another implementation, the electronic may be positioned within the receptacle, attached to the bladder wall, while the bladder wall serves as part of the spherical bladder and after the spherical bladder has been molded. In each of the above described examples, the attachment of the electronics 40 to the bladder wall (at some stage of the formation of bladder 14) occurs prior to the formation of the elastomeric layer 28, allowing the elastomeric layer 28 to be subsequently formed so as to continuously extend across and over the electronics 40.

As indicated by block 106, an elastomeric layer, such as elastomeric layer 28, is formed over the bladder 14 while the electronics 40 are within the bladder 14 formed by the bladder wall. In one implementation, the elastomeric layer 28 directly extends over the electronics 40 within the bladder 14. In one implementation, elastomeric layer 28 directly extends over and across the mouth 36 of the receptacle 18 containing the electronics 40. In one implementation, the elastomeric layer 28 is formed over windings, such as windings 26, which also extend over the bladder and over the electronics within the bladder. As will be described hereafter, in other implementations, the elastomeric layer may be formed over and across an opening in the windings, the opening in the windings communicating with the receptacle and the contained electronics. In one implementation, the elastomeric layer can be formed by locating multiple distinct panels or elastomeric layer portions over the bladder, and over windings or over the windings and the receptacle communicating opening in the windings.

As indicated by block 108, the elastomeric layer, the bladder and the windings are molded in a carcass-forming mold while the electronics are within the bladder. In one implementation, the bladder and the overlaid portions of the elastomeric layer are inserted into a spherical carcass-forming mold, wherein heat and/or pressure are applied to mold the material or materials of the cover layer. In one implementation, the molding results in the different layer panels or portions being fused into a continuous integral unitary homogenous layer to form a carcass. In another implementation, the overlaid portions of the elastomeric layer are applied to the wound bladder before being placed into the carcass-forming mold. In another implementation, the cover layer is molded by injection molding or other fabrication techniques.

In one implementation, during the molding of elastomeric layer 28 (the carcass molding), the exterior surface of the elastomeric layer is molded or shaped to include valleys defined by inner edges of the cover layer that form the grooves or channels of the basketball 10. In another implementation, during the molding of the elastomeric layer 28 (the carcass molding), the exterior surface of the elastomeric layer is molded with a plurality of outwardly projecting ribs that define cover panel placement locations. In one implementation in which elastomeric layer also serves as the exterior surface of the basketball, the outer or exterior surface of the elastomeric layer can be formed with a plurality of pebbled projections or pebbling between the valleys to facilitate gripping. In some implementations, the basketball may include additional outer panels, wherein method 100 results in the formation of what is referred to as a carcass, wherein the molded elastomeric layer is the outer surface of the carcass.

During carcass molding, heat is applied to the layer or layers of material forming the elastomeric layer 28. Although the heat applied during the carcass molding process is sufficient to fuse and/or melt at least portions of the panel or portions forming the elastomeric layer, such sheet is insufficient to damage the electronics within the bladder. In one implementation, the elastomeric layer 28 is formed of sponge rubber that is initially applied as uncured rubber with a foaming agent. During the carcass molding process, the foaming agent is activated to form sponge rubber. Because the elastomeric layer (and the carcass) is molded while the electronics are within the bladder, electronics may be encased and covered by the continuous and uniform elastomeric layer that extends about a majority if not substantially all of the spherical outer surface of the basketball. The continuity and uniformity of the elastomeric layer about a substantially all of the outer surface of the basketball shields the enclosure and electronics within the bladder to reduce any impact that the enclosure and the electronics within the bladder may have upon the bounce characteristics of the basketball when portions of the basketball adjacent the electronics are undergoing impact.

Figure 5B:
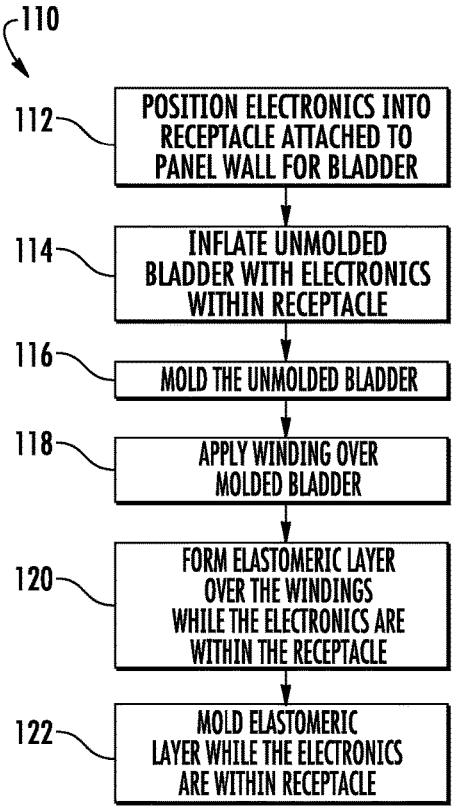
FIG. 5B is a flow diagram of another example method for forming the basketball of FIG. 1.
Figure 5C:
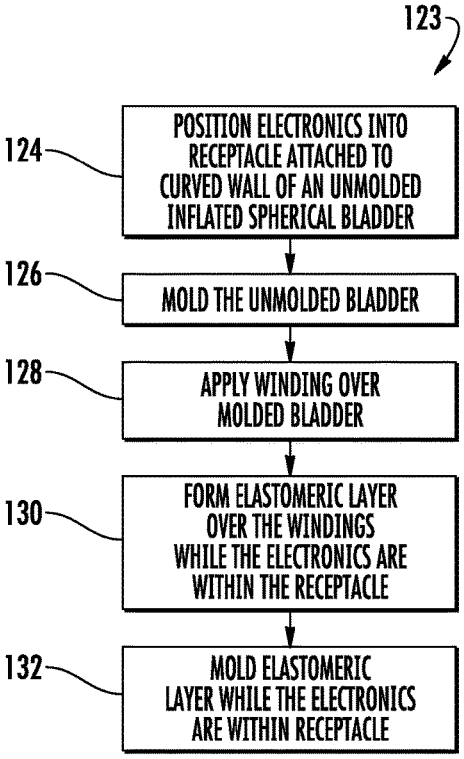
FIG. 5C is a flow diagram of another example method for forming the basketball of FIG. 1.
Figure 5D:
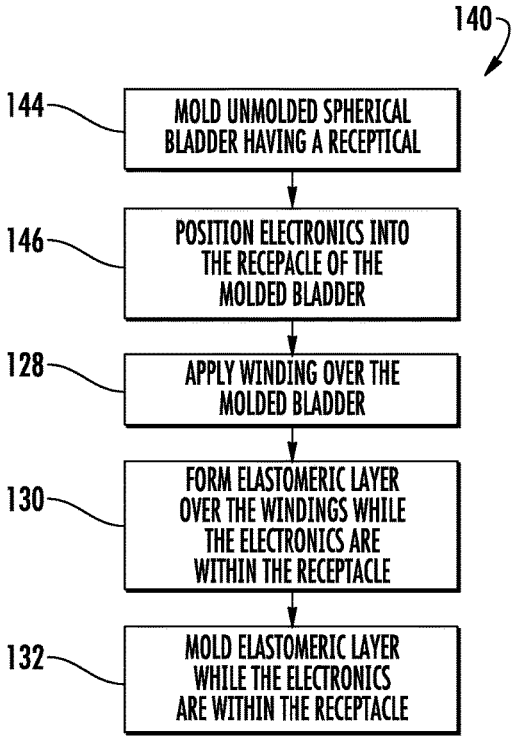
FIG. 5D is a flow diagram of another example method for forming the basketball of FIG. 1.
Figure 6:
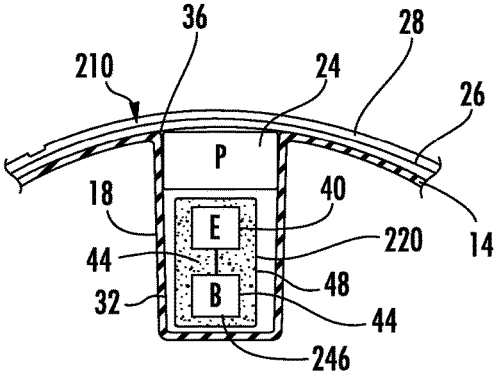
FIG. 6 is a fragmentary sectional view of another example basketball.
Figure 13B:
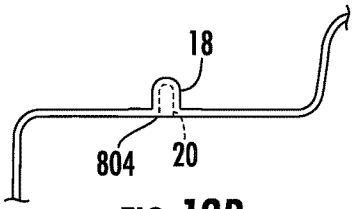
FIG. 13B is a sectional view of the panel of FIG. 13A taken along line 13B-13B and illustrating the optional insertion of an electronics insert.
Figure 13C:
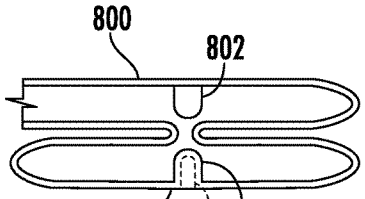
FIG. 13C is a sectional view of the panel of FIG. 13A after the panel has been folded relative to itself, further illustrating the optional insertion of an electronics insert.
Figure 14B:
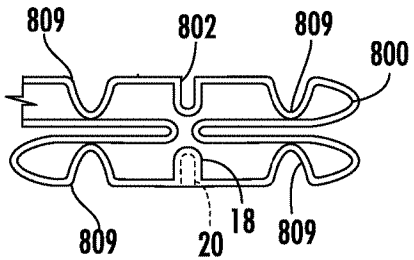
FIG. 14B is a sectional view of the folded and fused panel of FIG. 14A taken along line 14B-14B to form the preliminary inflatable body, further illustrating the optional insertion of an electronics insert.

FIGS. 5B-5D are flow diagrams illustrating specific implementations of the general method 100 outlined in FIG. 5. FIG. 5B is a flow diagram of an example method 110, wherein electronics are attached to the bladder wall by receptacle and wherein the electronics are inserted into the receptacle prior to inflation of the unmolded bladder. As indicated by block 112, electronics, such as electronics 40 (or insert 20) is positioned into receptacle 18 which is attached to the panel wall for the bladder 14. In one implementation, the electronics are inserted or positioned into the receptacle 18 while receptacle 18 is attached to a flat single layered panel, prior to the panel being folded relative to itself and being fused to form a spherical uninflated volume. For example, the electronics may be inserted into receptacle 18 at the stage shown in FIG. 13B, where the insert 20 is shown in broken lines to illustrate this option. In another implementation, the electronics inserted or positioned into the receptacle 18 while receptacle 18 is attached to a panel that has been folded relative to itself, but prior to the folded adjacent panels being fused to form the uninflated generally spherical bladder. For example, the electronics, as part of insert 20, may be inserted into receptacle 18 at the stage shown in FIG. 13C, where the insert 20 is shown in broken lines to illustrate this option. In yet another implementation, the electronics, as part of insert 20, may be inserted into receptacle 18 after adjacent portions the folded panel have been fused to form the uninflated bladder. For example, the electronics, as part of insert 20, may be inserted into receptacle 18 at this stage shown in FIG. 14B, where the insert 20 is shown in broken lines illustrate this option.

Block 114 of method 110 identifies the step of inflating the unmolded bladder while the electronics are within the receptacle 18. Such inflation occurs after spherical bladder has been formed from one or more panels fused or welded to one another. As indicated by block 112, electronics are inserted into the receptacle prior to such inflation.

Figure 16:
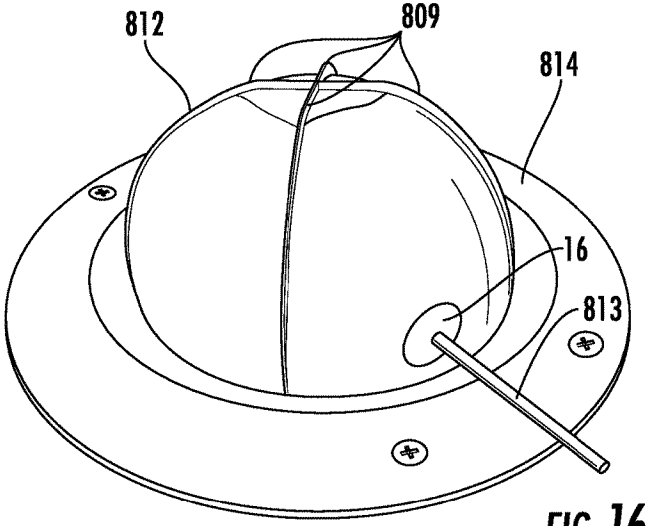

As indicated by block 116, the unmolded spherical bladder is molded (see FIG. 16 illustrating positioning of an unmolded spherical bladder or body 812 positioned within bladder forming mold 814). Such molding occurs while the electronics remain received or positioned within the receptacle. Such molding forms a more homogenous spherical body.

As indicated by block 118, windings, such as windings 26 described above, are applied over the molded bladder. In one implementation, the windings are applied over and across a top the receptacle with the electronic contained therein. As indicated by block 130, an elastomeric layer, such as elastomeric layer 28, is formed over the windings while the electronics are within the receptacle. As indicated by block 122, elastomeric layer is then molded while electronics are within the receptacle.

FIG. 5C is a flow diagram of an example method 123, wherein the electronics are attached to the bladder wall by a receptacle and wherein the electronics are inserted into the receptacle while the bladder wall is curved as part of an unmolded at least partially inflated spherical bladder. As indicated by block 124, the electronics, such as electronics 40, are positioned into a receptacle, such as receptacle 18, while the receptacle is attached to the wall of an unmolded spherical bladder. In some implementations, a plug is additionally positioned within the receptacle between the walls of the spherical bladder and the electronics.

In one implementation, the unmolded spherical bladder is formed by a single panel folded panel having adjacent portions sealed or joined to one another. In one implementation, the receptacle 18 is attached to one of the multiple panels (see bladder panel 800 in FIG. 12), prior to the multiple panels being folded and sealed to one another to form the spherical unmolded bladder.

As indicated by block 126, the unmolded spherical bladder is molded (see FIG. 16 illustrating positioning of an unmolded spherical bladder or body 812 positioned within bladder forming mold 814). Such molding occurs while the electronics remain received are positioned within the receptacle. Such molding forms a more homogenous spherical body.

As indicated by block 128, windings, such as windings 26 described above, are applied over the molded bladder. In one implementation, the windings are applied over and across a top the receptacle with the electronic contained therein. As indicated by block 130, an elastomeric layer, such as elastomeric layer 28, is formed over the windings while the electronics are within the receptacle. As indicated by block 132, elastomeric layer is then molded while electronics are within the receptacle.

FIG. 5D is a flow diagram of an example method 140, another implementation of method 100. Method 140 is similar to method 120 except that the electronics are positioned within the receptacle after molding of the bladder. Those steps in method 140 which correspond to steps in method 120 are numbered similarly. As indicated by block 144, the unmolded spherical bladder having a receptacle is molded. Block 144 is similar to block 126 except that the molding of block 144 occurs prior to positioning of electronics into the receptacle. As indicated by block 146, electronics are positioned into the receptacle of the molded bladder. Thereafter, the steps of blocks 128-132 are carried out. Block 128 includes the step of applying windings over the molded bladder. In another implementation, block 146 can be performed after block 144 and block 128. The windings 26 can be wound so as to not fully cover the mouth 36 of receptacle 18 to allow for the electronics, such as insert 20 to be inserted within the receptacle 18 of the wound bladder.

FIGS. 6-9 illustrate basketballs 210, 310, 410 and 510, respectively, other examples of basketball 10 described above. Ball 210 is similar to ball 10 except that ball 210 comprises electronics insert 220 in lieu of electronics insert 20. Those remaining components of ball 210 which correspond to components of basketball 10 are numbered similarly.

Electronic insert 220 is similar to electronics insert 20 except that potting material 44 completely encapsulates electronics 40 and battery 46. Encapsulating body 48 completely encloses and surrounds electronics 40 and battery 46, wherein electrical conductor 50 between electronics 40 and battery 46 is also completely encapsulated within body 48. As a result, body 48 offers additional protection for battery 46.

Figure 7:
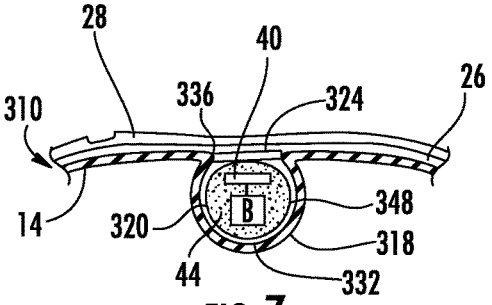
FIG. 7 is a fragmentary sectional view of another example basketball.

FIG. 7 is a fragmentary sectional view of basketball 310. Basketball 310 is similar to basketball 10 except that basketball 310 comprises electronics receptacle 318, electronics insert 320 and plug 324 in lieu of receptacle 18, electronics insert 20 and plug 24, respectively. Those remaining components of basketball 310 which correspond to components of ball 10 are numbered similarly.

Electronics receptacle 318 is similar to electronics receptacle 18 except that electronics receptacle 318 has a different shape. In the example illustrated, electronics receptacle 318 comprises a spherical cavity 332. In yet other implementations, electronics receptacle 318 may have other sizes and shapes.

Electronics insert 320 is similar to electronics insert 220 except that the potting material 44 is shaped so as to form encapsulating body 348 which corresponds to the shape of cavity 332. Similar to cavity 332, body 348 has a spherical outer shape or profile, limiting movement of insert 320 within cavity 332. In the example illustrated, due to the spherical shape of receptacle 318, cavity 332 as a mouth 324 which is smaller in size than the maximum internal dimensions of cavity 332 and which is smaller in size than the maximum outer dimensions of insert 320. During insertion of insert 320 into cavity 332, mouth 336 resiliently flexes or stretches to accommodate insert 320. Upon resiliently returning to and unstressed state, mouth 336 moves about body 348 and returns to a size smaller than the maximum outer dimension of body 348 to assist in retaining insert 320 within cavity 332.

Plug 324 is similar to plug 24. Plug 324 extends between body 348 and the exterior of ball 310. In the example illustrated, plug 324 is formed from a resiliently compressible or soft material to absorb impacts with ball 310 such that less forces are transmitted to insert 320. In the example illustrated, plug 324 further seals insert 320 within cavity 332. In the example illustrated, plug 324 has a reduced thickness as compared to plug 24 as mouth 336 assists in retaining insert 320 within cavity 332. In other implementations, plug 324 may have a larger thickness or may be configured similar to plug 24.

In some implementations, plug 24 or 324 may be omitted, may be supplemented with or may be replaced with one or more materials filled over body 48 or 348. For example, in one implementation, cavity 32 or cavity 332 is filled with a fluid filler material that at least partially immerses, in one implementation completely submerses, insert 220 or insert 320. In one implementation, the fluid filler material is chosen so as to solidify about insert 220 or insert 320 through curing or thermosetting. In yet other implementations, the fluid filler material remains in a fluid state, sealed within cavity by an additional plug or by additional outer layers of ball 10 or 310.

Figure 8:
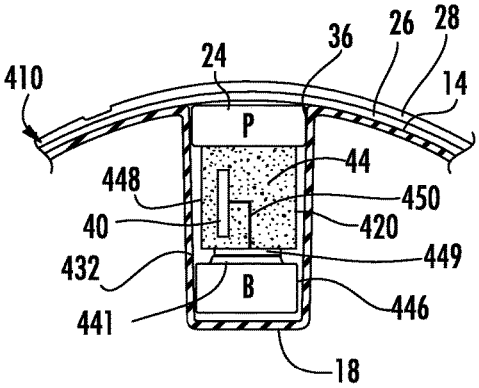
FIG. 8 is a fragmentary sectional view of another example basketball.
Figure 9:
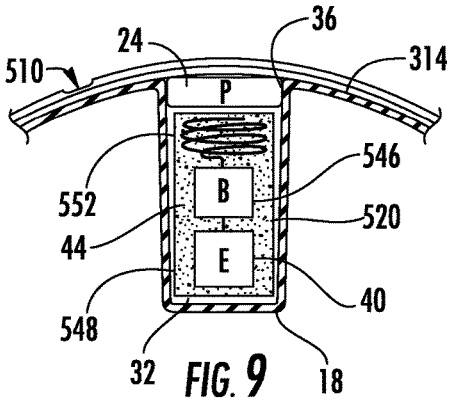
FIG. 9 is a fragmentary sectional view of another example basketball.

FIG. 8 is a fragmentary sectional view of sporting or game ball 410, shown as an example basketball. Ball 410 is similar to ball 210 except that ball 410 comprises electronics insert 420 and battery 446 in lieu of electronics insert 220 and battery 46. Those remaining components of ball 410 which correspond to components of basketball 210 are numbered similarly.

Electronics insert 420 is similar to electronics insert 220 except that potting material 44 does not encapsulate a battery, but encapsulates electronics 40. In the example illustrated, insert 420 additionally comprises an external electrical contact pad or terminal 449 which is electrically connected to electronics 40 by electrical conductor 441. In the example illustrated, potting material 44 completely encapsulates electronics 40 and is solidified about electrical conductor 450 to seal against electrical conductor 450. In other implementations, a bore or other passage is formed within body 448, wherein electric conductor 450 extends through and within the bore or other passage to terminal 449. Terminal 449 facilitates electrical power transfer between battery 446 and electronics 40 across terminal 439 and conductor 450.

Battery 446 is similar to battery 46 except that battery 446 is distinct and independent, or separable, from insert 420. Battery 446 is inserted into cavity 432 prior to insertion of insert for 20. In another implementation, battery 446 is inserted into cavity 432 after insertion of insert for 20 into cavity 432. Battery 446 comprises electrical contact pad or terminal 441 which is configured for electrical contact with terminal 449 of insert 420 when both are inserted into cavity 432. In the example illustrated, terminals 441 and 449 rest against and in contact with one another. Electrical power is transmitted across terminals 441 and 449 to electrical conductor 450 and ultimately to electronics 40. Because battery 446 is independent of insert 420, battery for 46 may also be replaced independent of insert 420, allowing the use of insert 420 to be continued with a replacement battery.

Ball 510 is similar to ball 210 except that ball 510 comprises electronics insert 520 in lieu of electronics insert 220 and battery 246. Those remaining components of ball 510 which correspond to components of ball 210 are numbered similarly.

Insert 520 is similar to insert to 20 except that insert 520 additionally comprises inductive coil 552. Inductive coil 552 comprises an electrically conductive line such as an electrically conductive metal wire, trace or the like which serves as a secondary coil to facilitate inductive charging of battery 546. In the example illustrated, inductive coil 552 extends from and is electrically connected to battery 546 (either directly or through electronics 40), wherein inductive coil 552 forms windings or loops within the mass of potting material 44 (shown with stippling) proximate to or along a portion of body 48 which is proximate to or adjacent to plug 24 and the exterior of ball 510. In such an implementation, potting material 44 completely encapsulates inductive coil 552 to protect coil 552. In another implementation, inductive coil 552 alternatively extends along an outer surface of encapsulating body 48 for closer proximity to an exterior basketball 510 and for enhanced inductive charging.

Battery 546 comprises a rechargeable battery. In the example illustrated, battery 546 comprises a battery configured to be inductively recharged utilizing coil 552 as a secondary inductive charging coil. During such recharging, ball 510 is positioned adjacent to an inductive charger having a primary inductive charging coil which creates an electromagnetic field that encompasses coil 552. In one implementation, the material and configuration of the primary coil and coil 552, serving as a secondary coil, have matched or substantially matched resonant frequencies to enhance the rate at which battery 546 is inductively charged. In another implementation, the primary coil of the inductive charger and coil 552 may have different resonant frequencies.

Figure 10:
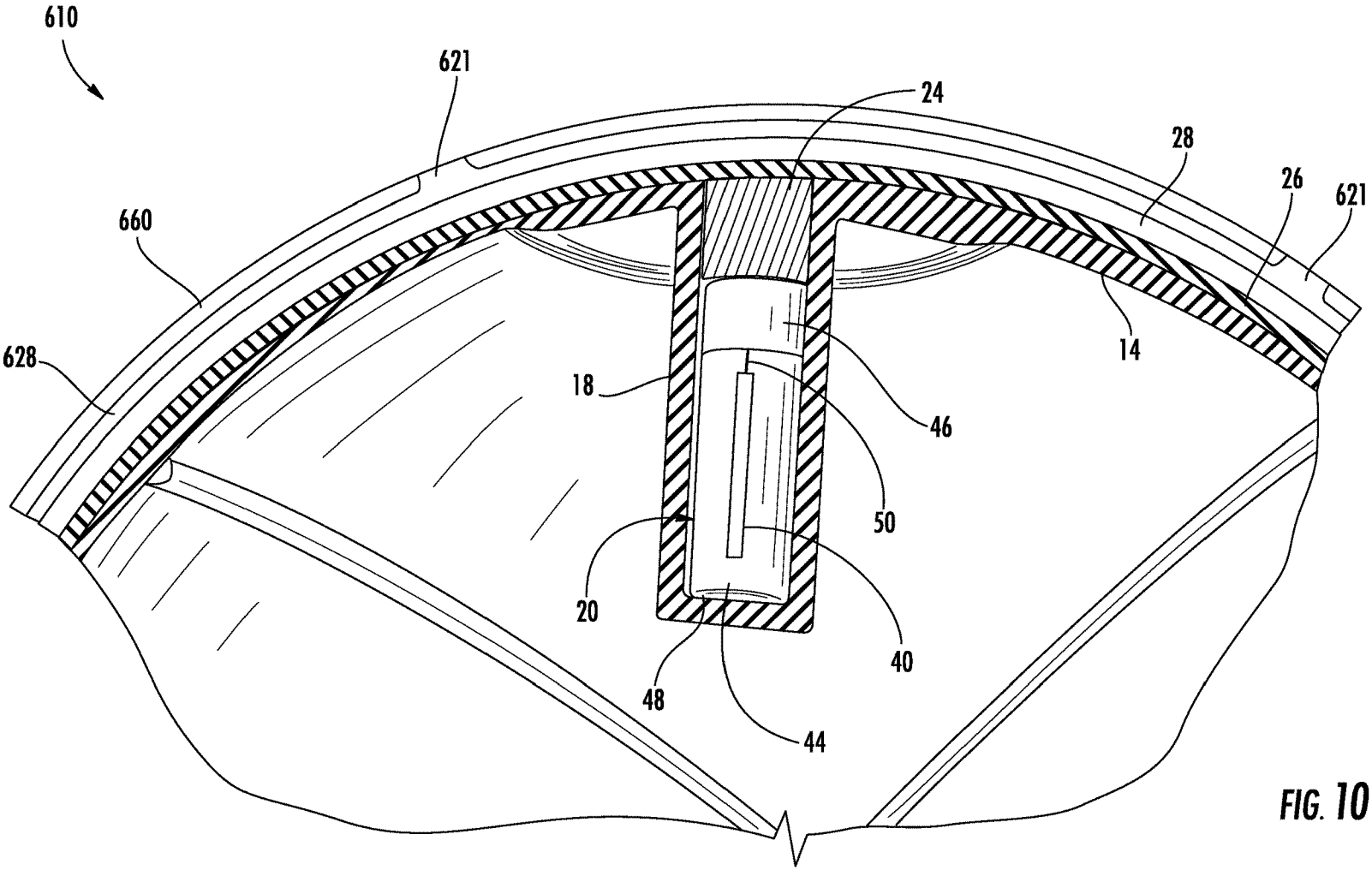
FIG. 10 is an enlarged fragmentary sectional view of another example basketball.

FIG. 10 is a fragmentary sectional view of basketball 610, another example implementation of basketball 10. Basketball 610 is similar to basketball 10 except that basketball 610 comprises elastomeric layer 628 in place of elastomeric layer 28 and further comprises outer a plurality of cover panels 660. Those remaining components or structures of basketball 610 which correspond to components or structures of basketball 10 are numbered similarly.

Unlike elastomeric layer 28, elastomeric layer 628 is not the outer surface of the basketball, but is instead the outer surface of a carcass. Elastomeric layer 628 is similar to elastomeric layer 28 described above except that elastomeric layer 628 is alternatively shaped or molded to include outwardly or radially projecting walls, ribs or dividers 621 in place of valleys 54. Dividers 621 partition the exterior of elastomeric layer 628 into cover panel recesses, cavities or channels receiving outer cover panels 660. In one implementation, dividers 621 can include an outer curved surface that forms grooves in the outer surface of the dividers 621. In another implementation, the outer surface of the dividers 621 can be formed to include a plurality of pebbled projection or pebbling. In such an implementation where outer cover panels 660 extend over elastomeric layer 628, the formation of pebbles in elastomeric layer 628 may be omitted. As with elastomeric layer 28, portions of elastomeric layer 628 can be translucent or transparent in some implementations. In one implementation, those portions of elastomeric layer 628 forming one or more of dividers 621 are transparent or translucent to allow light to pass through dividers 61 while other portions of cover layer 628 are opaque or have different light transmissive properties.

Outer cover panels 660 comprise panels of material secured within the channels or cavities formed by dividers 621 along an exterior of basketball 610. In one implementation, cover panels 660 are formed from a wear-resistant, resilient material having a high coefficient of friction value (or a high level of grip-ability), such as leather, synthetic leather, rubber, polyurethane, thermoplastic material, thermoset material, or other synthetic polymeric materials and the like. Cover panels 660 include at least two cover panels 660 and less than or equal to sixteen cover panels 660. In some implementations, the cover panels can number eight, ten or twelve cover panels 660. The cover panels 660 include peripheral edges that extend to dividers 621. The cover panels are configured for impact with one or more playing surfaces and for contact with players. In one implementation, the exterior surface of such cover panels 660 include a pebbled texture. Each cover panel may additionally comprise the fabric backing coated with an adhesive prior to being secured to elastomeric layer 628 which may also be alternatively coated with an adhesive. In some implementations, at least portions of one or more of cover panels 660 are translucent or transparent. In another implementation, cover panel 660 can be one cover panel surrounding the carcass.

The backing is configured to increase the tensile strength of the cover panels 660. The backing is made of a soft material, preferably a felt-like fabric. Alternatively, the backing can be formed of other materials, such as, for example, other woven or unwoven fabrics, plastic, an elastomer, a rubber, and combinations thereof. The backing is preferably configured to contact the outer surface of the carcass 29. In an alternative preferred embodiment, the cover panels 660 can be formed without a backing. In one implementation, peripheral regions of the backing (and/or the outer layer of the cover panels 660) can be skived (tapered or thinned out) to produce a recess in the outer surface of the basketball 10 near the dividers 621. In another implementation, the cover assembly 14 can be connected directly to the bladder 12 or to the layer of windings 14.

Figure 11A:
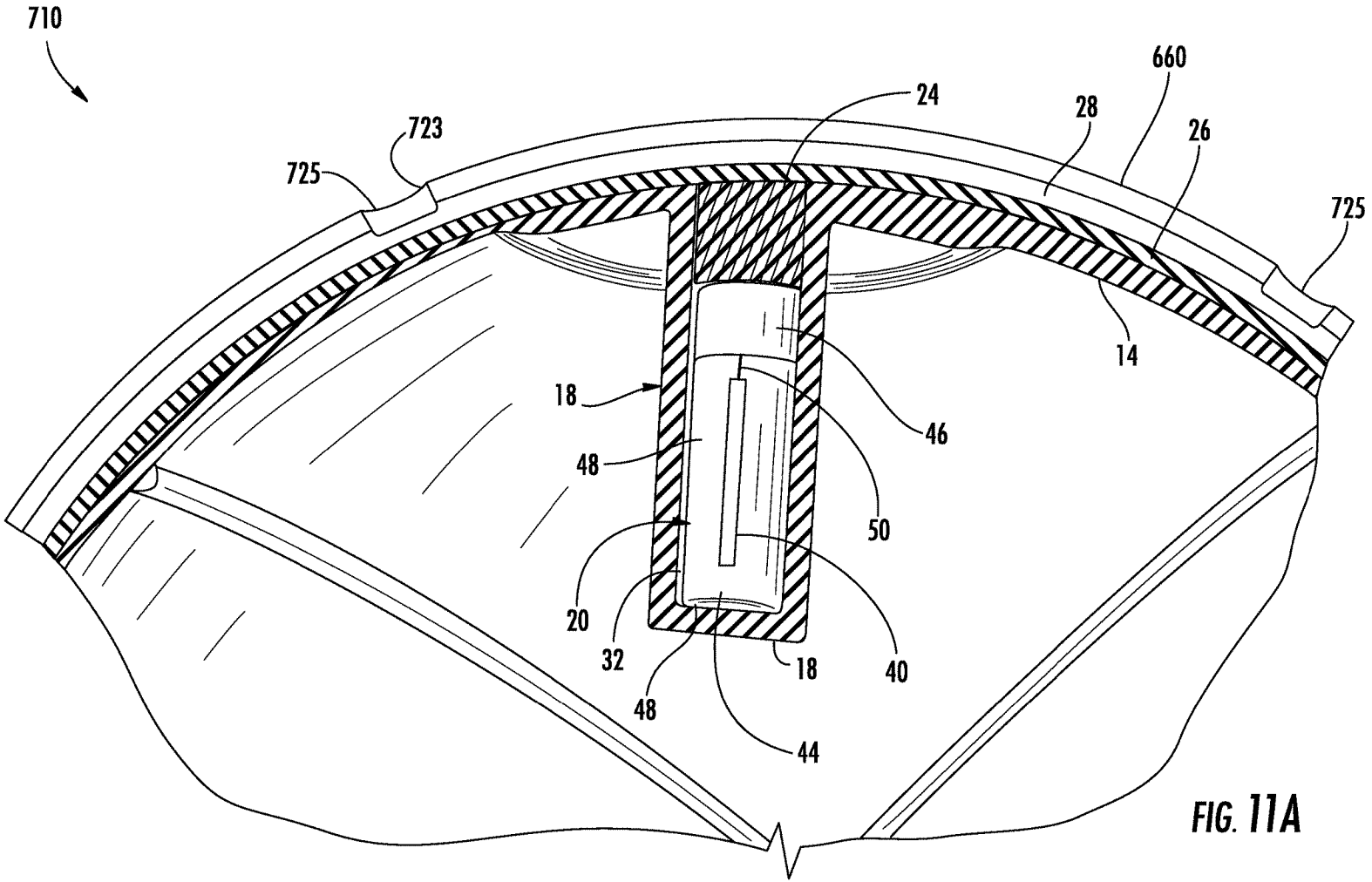
FIG. 11A is an enlarged fragmentary sectional view of another example basketball.

FIG. 11A is a fragmentary sectional view of basketball 710, another example implementation of basketball 10. Basketball 710 is similar to basketball 10 except that basketball 710 further comprises further comprises outer cover panels 660 (described above) and strips 725. Those remaining components or structures of basketball 610 which correspond to components or structures of basketball 10 are numbered similarly.

Strips 725 comprise elongate bands, tubes, cords or the like secured within valleys 54 and extending upwardly along adjacent opposite sides of cover panels 660. The material of strips 725 have good grippability and relatively high coefficient of friction. In one implementation, material of the strips 625 is chosen to match grip and feel of cover panels 660 so that the grooves 723 of the basketball 710 do not include areas of reduced gripability on the surface of basketball 710. The color of the material of strips 625 can contrast the color of the cover panels 660 provide visible evidence of grooves 723. In one implementation, strips 625 are black. In one implementation, strips 625 comprise urethane-coated microfiber having a thickness of about 1.5 mm. In one implementation, the bottom of such strips 325 is coated with adhesive so as to adhere to cover its 28 (or carcass) during a final molding step. In one implementation, the material strips 625 is translucent or transparent.

In the example illustrated, basketball 710 is formed according to method 120 shown in FIG. 5B, in particular, during the forming of basketball 710, electronics 20 are inserted into receptacle 18 prior to the molding of bladder 14. Prior to the molding of bladder 14, a plug 24 is additionally inserted within receptacle 18 above electronics 20 within receptacle 18. During molding, sufficient heat is applied to bladder 14 such that at least outer circumferential portions of plug 24 melt and fuse to adjacent portions of bladder 14 such that one continuous layer of material extends about all of basketball 710 and across the mouth of receptacle 18. In one implementation, the material of plug 24 is compatible with the material of bladder 14 to facilitate such fusing. In one implementation, the material of plug 24 is same as the material forming bladder 14.

Figure 11B:
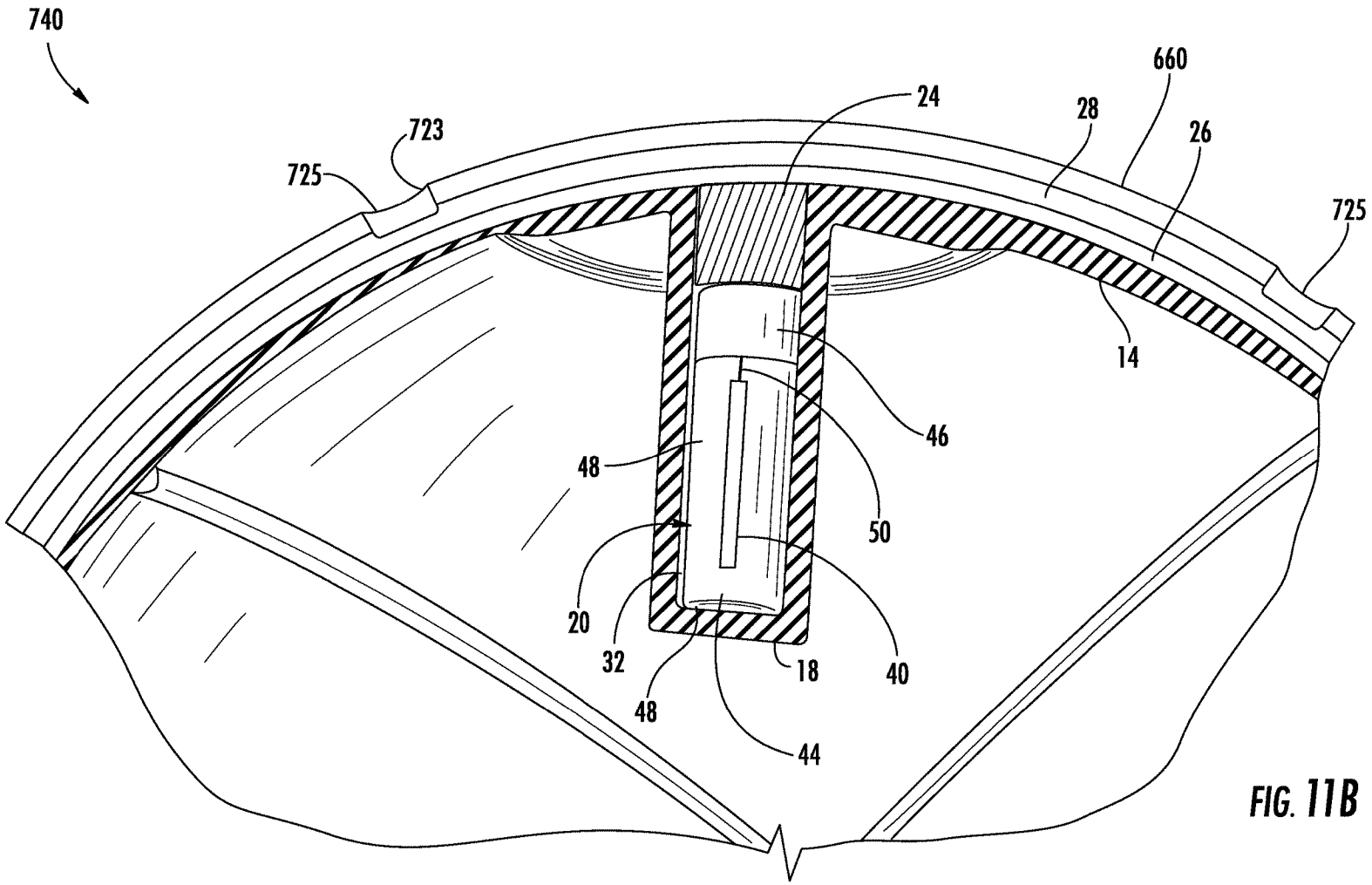
FIG. 11B is an enlarged fragmentary sectional view of another example basketball.

FIG. 11B is a sectional view illustrating basketball 740, another implementation of basketball 10. Basketball 740 is formed using method 140 shown in FIG. 5D. Basketball 740 is similar to basketball 710 except that plug 24 is inserted over electronics 20 within receptacle 18 after molding of bladder 14

Figure 11C:
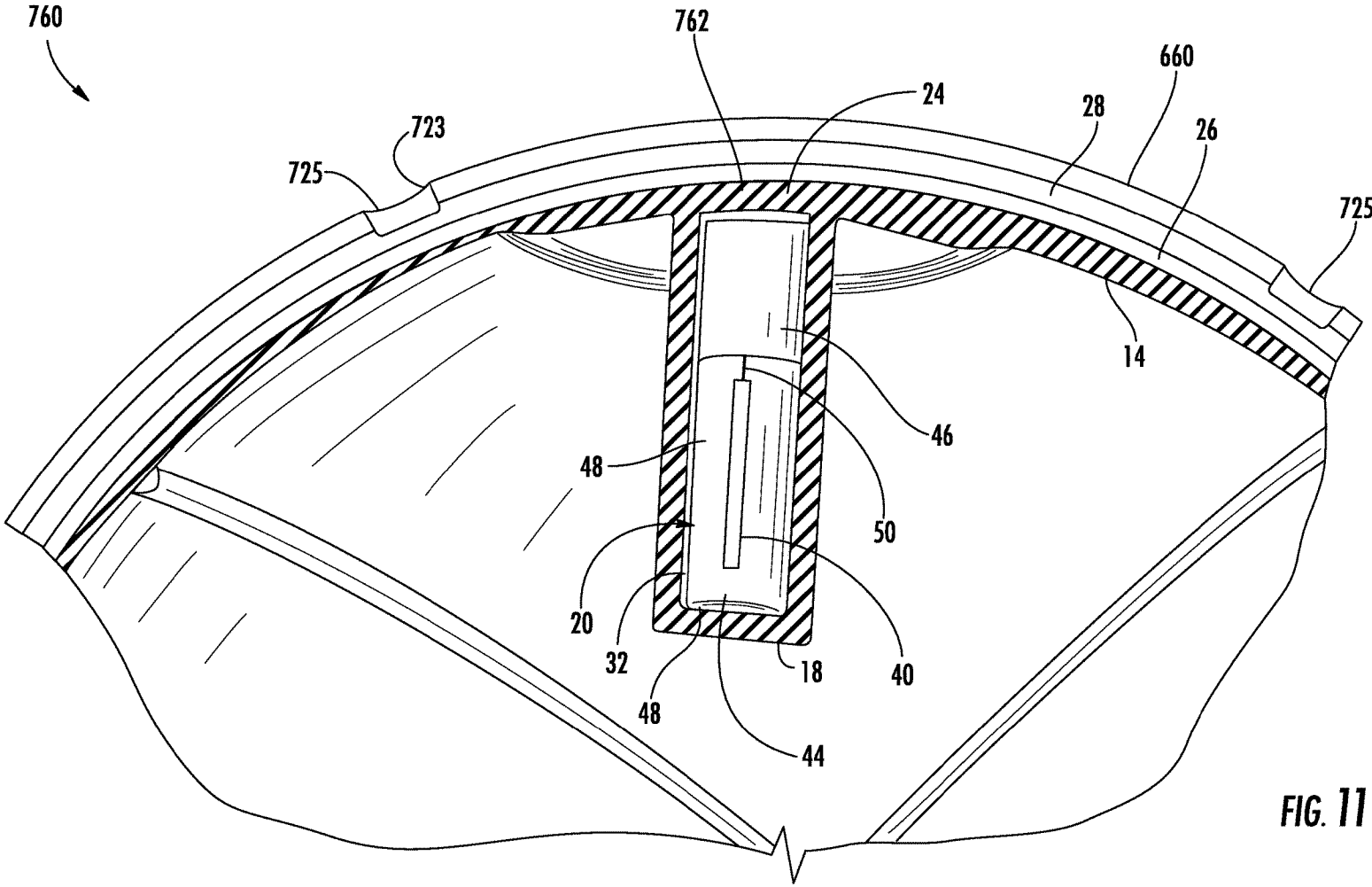
FIG. 11C is an enlarged fragmentary sectional view of another example basketball.

FIG. 11C is a sectional view illustrating basketball 760, another implementation of basketball 10. Basketball 760 is similar to basketball 710 except that basketball 760 omits plug 24 and wherein the bladder 14 has an overlying cover portion 762. Those remaining components of basketball 760 which correspond to components of basketball 710 are numbered similarly.

Cover portion 762 extends across the mouth of receptacle 18 to contain electronics 20 within receptacle 18. In one implementation, cover portion 762 comprises a flap which is pivoted to an open position allowing electronics 20 to be inserted through the mouth of receptacle 18, wherein the flap is returned to cover the inserted electronics 20. In implementations where electronics 20 are inserted into receptacle 18 prior to molding of bladder 14, such molding of bladder 14 may result in the flap forming portion 762 to become fused or sealed to adjacent portions of bladder 14 over electronics 20 within receptacle 18. In other implementations, the unmolded bladder 14 has an opening through which electronics 20 are inserted into receptacle 18, wherein during molding of bladder 14, the material of bladder 14 melts and flows to fill the opening so as to form cover portion 762. In yet other implementations, basketball 760 may omit cover portion 762, wherein windings 26 extend across the mouth of receptacle 18 to contain electronics 20 within receptacle 18.

Figure 13A:
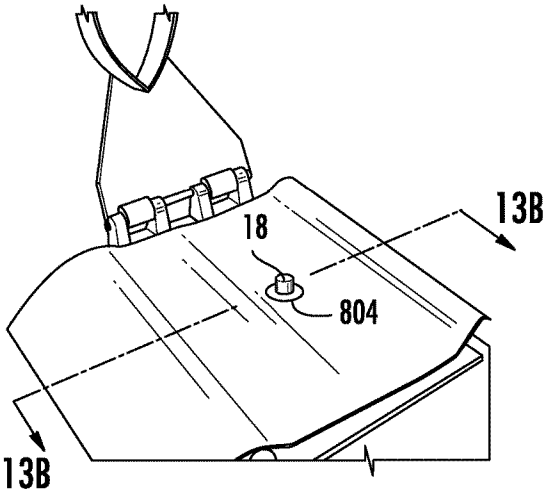
FIG. 13A is a perspective view illustrating attachment of an insert to the panel through one of the formed apertures.
Figure 12:
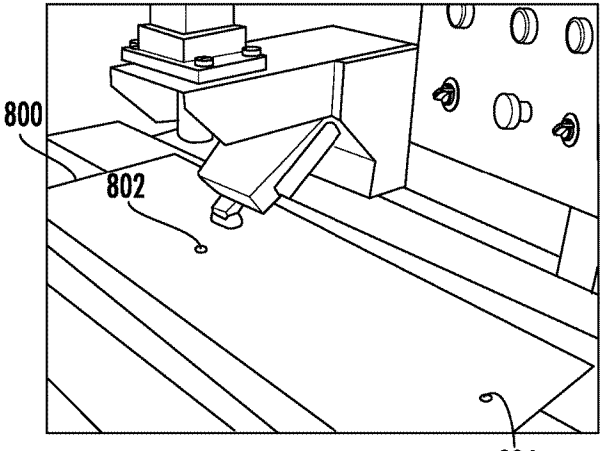
Figure 14A:
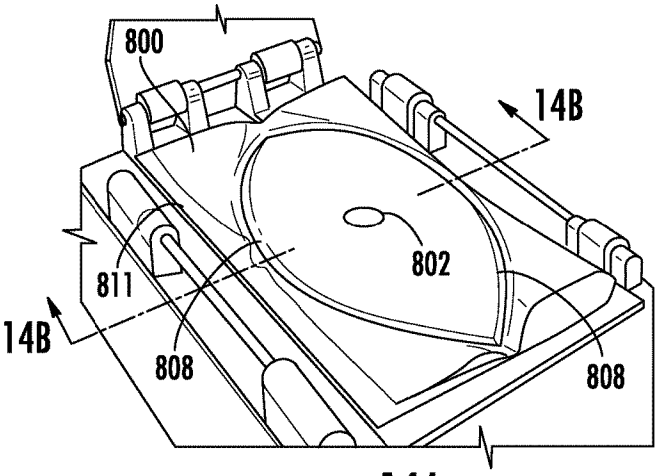
FIG. 14A is a perspective view illustrating welding or fusing of adjacent folded portions of the folded panel of FIG. 13C to form the preliminary inflatable body.

FIGS. 12-28 illustrate one example method for forming basketball 710. In some implementations, some of the steps illustrated in FIGS. 12-28 may be slightly modified or omitted to facilitate the creation of other basketballs such as basketballs 10 (along with its variations-basketballs to 10, 310, 410, 510 and 610). FIGS. 12-15 illustrate an example method for forming the bladder. As shown by FIG. 12, bladder 14 is formed from a panel 800 of material, such as butyl rubber, latex, natural rubber, other elastic materials, combinations thereof. In one implementation, bladder 14 is made from 80% butyl rubber and 20% natural rubber. As shown by FIG. 12, two openings are formed or punched through the panel 800: a first opening 802 for valve 16; and a second opening 804 for receptacle 18. As shown by FIG. 13, receptacle 18 is positioned through opening 804 and is joined to panel 800. In one implementation, receptacle 18 comprises an outer rim that is overlapped with portions of panel 800 about opening 804, wherein the outer rim and the adjacent portions a panel 800 are fused or melted to one another such that receptacle 18 forms an airtight enclosure through opening 804. In another implementation, panel 800 can be formed without opening 804 and the receptacle with electronics 40 positioned within it are attached (fused, melted or molded) to one side of the panel 800 at the location of opening 804. In a similar manner, valve 16 is positioned within opening 802 and is fused or otherwise joined to panel 800 while extending within and beyond opening 802 so as to form an airtight juncture with panel 800 at opening 802.

Figure 15:
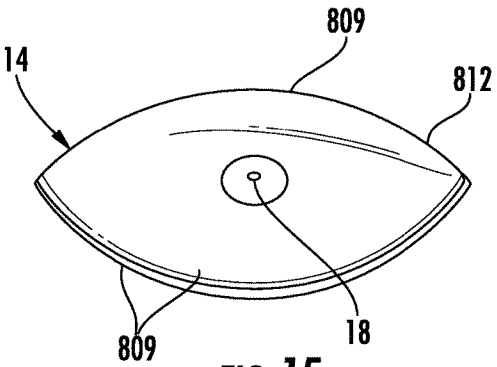

As shown by FIGS. 13A-15, panel 800, with the joined or supported valve 16 and receptacle 18, is folded over itself, and heat is applied along lines 808 to weld, fuse or otherwise joined overlapping portions of panel 800 to one another to form the collapsed, preliminary body 812 of bladder 14. Seams 809 may be formed at the location of the lines 808. As shown by FIG. 15, the exterior or extraneous portions 811 of panel 800 are separated and removed, leaving the collapsed preliminary inflatable body 812 of bladder 14 and the supported valve 16 and enclosure 18.

FIGS. 16-19 illustrate inflation of and molding of the preliminary inflatable body 812 of bladder 14 of FIG. 15. As shown by FIG. 16, the preliminary inflatable body 812 of bladder 14 is inflated. In particular, an inflation needle 813 is positioned through valve 16 to inflate the interior of body 812. In one example method, the preliminary inflatable body 812 of bladder 14 is positioned within a portion of a mold 814 during inflation, wherein the mold 814 will be subsequent used to mold body 812.

Figure 17:
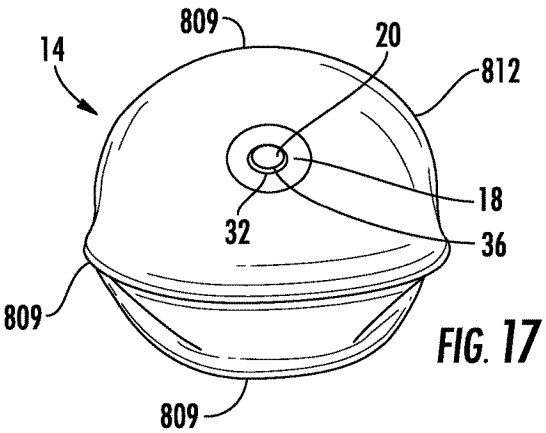
FIGS. 16-19 are perspective views illustrating one example method for forming an example bladder from the preliminary inflatable body of FIG. 15 for any of the basketballs of FIGS. 1, 6-9, 10 and 11.

As shown in FIG. 17, in one implementation, electronics insert 20 (or any of the other electronic inserts described above) is inserted through mouth 36 into cavity 32 of receptacle 18 before the body 812 is molded in a bladder-forming mold 814. As described above, in some implementations, electronics insert 20 is positioned within cavity 32 without any cover or top. In some implementations, electronics insert 20 is adhered or otherwise retained within cavity 32. In yet other implementations, plug 24 (illustrated in FIG. 4) is positioned over the inserted electronics inserts 20. In another implementation, the plug 24 can be formed by a flap of the panel 800 positioned over the mouth after the electronics insert is inserted within receptacle 18. In one implementation, a lubricant can be used with the electronics insert 20 to allow for independent movement of the insert 20 and the receptacle 18 during use. A lubricant can also be used to facilitate the insertion of the electronics insert 20 within the receptacle.

The two clamshell mold halves (one of which is shown) of the bladder-forming mold 814 are positioned about the preliminary inflatable body 812. The mold halves of the bladder-forming mold 814 are heated to apply heat to the preliminary inflatable body 812. In some implementations, during the application of heat, body 812 is further inflated through inflation needle 813 to a greater extent, forcing body 812 against the interior molding surfaces of mold halves 814. In the example illustrated, the molding of preliminary inflatable body 812 occurs while electronics insert 20 is being retained within receptacle 18. In the example illustrated in which a plug 24 is additionally inserted into receptacle 18 above the inserted electronics insert 20, the heat applied during molding of body 812 at least partially melts and fuses adjacent portions of the plug 24 and body 812 (the unmolded bladder) to form a unitary, continuous structure over and across receptacle 18. As disclosed above with respect to FIG. 11A, in such an implementation, the plug is formed from a material that is the same as or that is compatible with body 812 such that plug 24 fuses to body 812 during molding a body 812.

Figure 19:
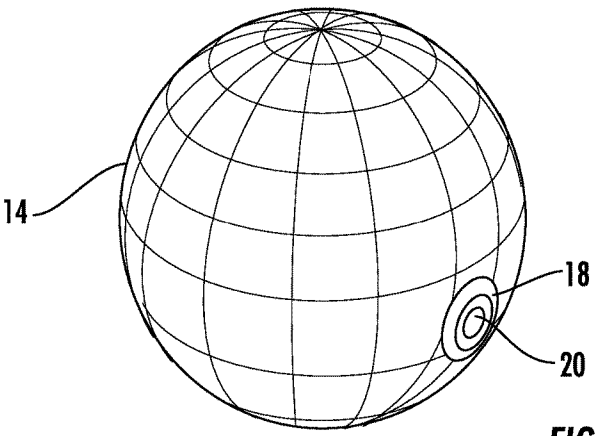
Figure 18:
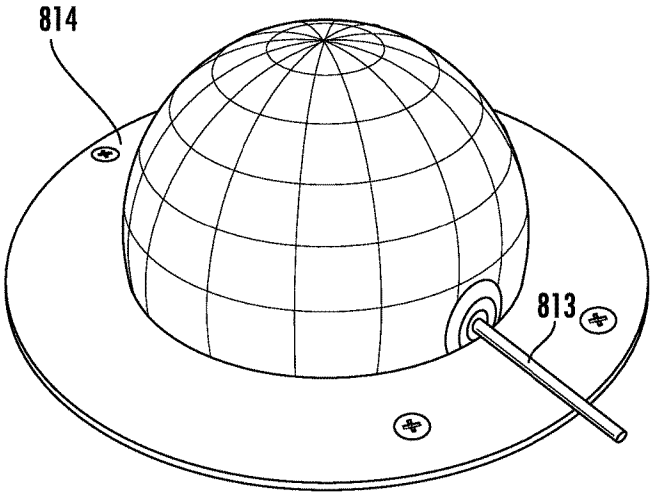

FIGS. 18 and 19 illustrate the molded bladder 14 formed from the preliminary inflatable body 812 after removal from mold halves of the bladder-forming mold 814. Although FIG. 17 illustrates the positioning insertion of electronics insert 20 into receptacle 18 prior to molding of the preliminary inflatable body 812 of bladder 14, in other implementations, electronics insert 20 may be inserted into receptacle 18 after preliminary inflatable body 812 has been molded to the final configuration of bladder 14 shown in FIG. 19. In such an implementation, electronic insert 20 is not subjected to the heat applied to body 812 during the molding of body 812.

Figure 20:
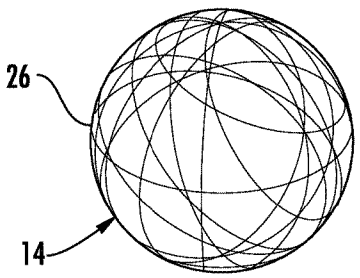
FIGS. 20 and 21 are perspective views illustrating one example method for winding of the bladder to form a wound bladder for any of the basketballs of FIGS. 1, 6-9, 10 and 11.
Figure 21:
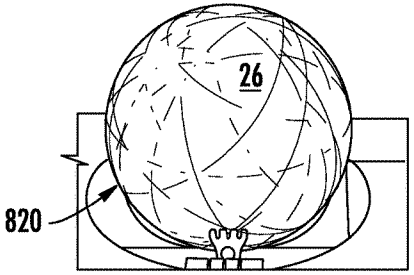

FIGS. 20 and 21 illustrate the forming of windings 26 over and about bladder 14 of FIG. 19 to form the wound bladder 820 shown in FIG. 20. Such windings 26 comprise a layer of wound reinforcing thread wound about or over bladder 14. The layer of wound reinforcing thread continuously extends over receptacle 18 and across mouth 36 (shown in FIG. 17). As a result, winding 26 forms a continuous and uninterrupted as well substantially uniform layer about the entirety of bladder 14.

In one implementation, prior to the application of cover layer 28, the reinforcing thread may be further coated or covered with a viscous material, such as a latex or adhesive. In one implementation, the reinforcing thread is passed through a viscous adhesive material prior to being wound about bladder 14. In one implementation, the thread forming windings 26 comprises nylon 66. In other implementations, the thread are material forming windings 26 may comprise other materials.

Figure 22:
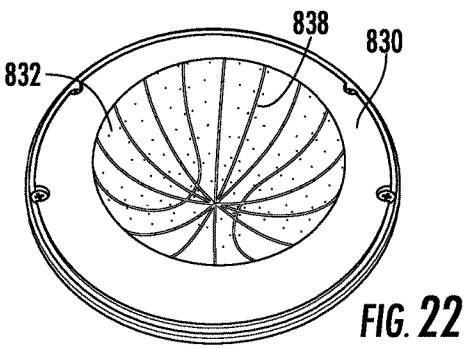
FIGS. 22-26 are perspective views illustrating one example method for forming and molding of an example cover layer for any of the basketballs of FIGS. 1, 6-9, 10 and 11.
Figure 23:
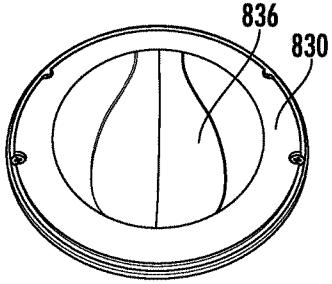
Figure 24:
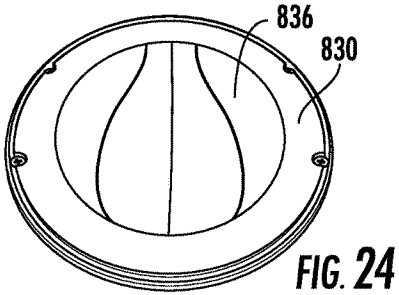

FIGS. 22-26 illustrate the formation of elastomeric layer 28. FIG. 22 illustrates a lower portion of a clamshell carcass-forming mold 830. As shown by FIGS. 23 and 24, the interior 832 of each of mold halves of the carcass-forming mold 830 are lined with the material to form elastomeric layer 28. In one implementation, elastomeric layer 28 comprises a layer of elastic material over and about windings 26. In one implementation, elastomeric layer 28 comprises a natural rubber, a butyl rubber, a sponge rubber or a combination thereof as described in U.S. Pat. No. 5,681,233.

Figure 25:
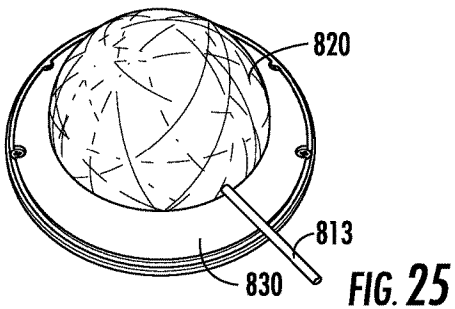

As further shown by FIGS. 23 and 24, mold halves of the carcass-forming mold 830 are lined by laying panels or sheets 836 of the cover layer material. As shown by FIG. 25, the wound bladder 820 of FIG. 21 is inserted within interior 832 of the lower mold half of the carcass-forming mold 830 on top of the cover layer panels 836 lining the interior 832 of the lower mold half of the carcass-forming mold 830. The upper mold half 830, lined with panels 836, is positioned over on top of wound bladder 820 to completely enclose wound bladder 820 between the elastomeric material lined mold halves of the carcass-forming mold 830. In another implementation, the panels or sheets 836 of pre-cured elastomeric material can be applied directly to the wound bladder 820 before placing the assembly into the bladder-forming mold 830. Thereafter, the carcass-forming mold 830 applies heat to the contained panels 836 and wound bladder 820 to mold and fuse the panels 836 into a continuous integral unitary homogenous cover layer 28 over windings 26. When the panels 836 are formed of pre-formed or pre-cured sponge rubber, the heat also activates the foaming agent to form the sponge rubber. In one implementation, the wound bladder 820 is further inflated through inflation needle 813 to urge exterior wound bladder 820 into contact with panels 836 which urges panel 836 against the shapes and configurations of interior 832 of mold halves of the carcass-forming mold 830.

Figure 26:
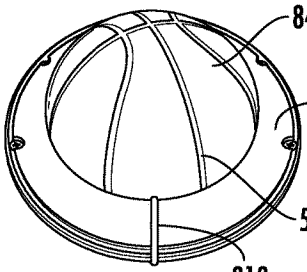

FIG. 26 illustrates the resulting carcass 840 partially within one of mold halves of the carcass-forming mold 830. As shown by FIG. 26, the exterior circumferential surface of carcass 840 includes grooves 54 formed by the corresponding ribs 838 along the interior 832 of mold halves of the carcass-forming mold 830. In other implementations, interior 832 of each of mold halves of the carcass-forming mold 830 may have other configurations to form other surface configurations, if any, along and over the exterior of carcass 840. For example, in other implementations, the interior 32 alternatively include grooves so as to form the dividers 621 such as when forming a carcass for basketball 610. In implementations where cover layer 28 serves as the exterior surface of the basketball, the exterior surface of cover layer 28 may additionally have molded thereon outwardly projecting pebbles between valleys 54. In other implementations, cover layer 28 is formed by injection molding or other fabrication techniques.

Figure 27:
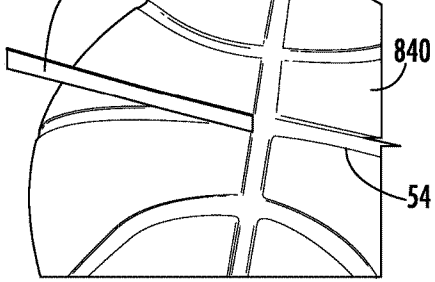
FIG. 27 is a perspective view illustrating one example method for applying channel strips to a carcass to form the basketball of FIG. 11.

FIG. 27 illustrates the application of strips 725 to the carcass 840. In particular, FIG. 27 illustrates the application of strips 725 within grooves 54 molded along the outer surface of carcass 840. In the example illustrated, strips 725 comprise elongate bands, tubes, cords or the like secured within valleys 54 and extending upwardly along adjacent opposite sides of cover panels 620. The material of strips 625 have good grippability and relatively high coefficient of friction. In one implementation, the material of the strips 625 is chosen to match grip and feel of cover panels 720 so that the grooves 723 of the basketball 710 do not include areas of reduced gripability on the surface of basketball 710. The color of the material of strips 625 can contrast the color of the cover panels 620 provide visible evidence of grooves 723 (shown in FIG. 11). In one implementation, strips 625 are black. In one implementation, strips 625 comprise urethane-coated microfiber having a thickness of about 1.5 mm. In one implementation, the bottom of such strips 325 is coated with adhesive so as to adhere to cover layer 28 (or carcass) during a final molding step. In one implementation, the material of strips 725 is translucent or transparent.

Figure 28:
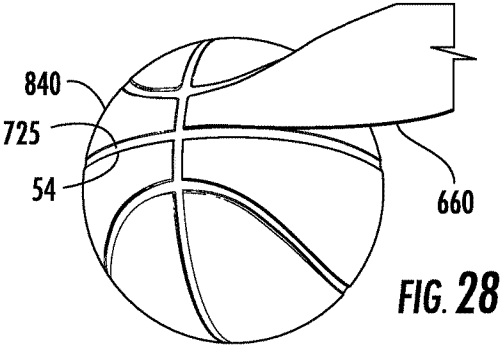
FIG. 28 is a perspective view illustrating one example method for the application of outer cover panels to the carcass for form the basketball of FIG. 11.

FIG. 28 illustrates the application of outer cover panels 660 to the exterior service of carcass 840 between grooves 54 and between strips 725. Outer cover panels 660 comprise panels of material secured along an exterior of basketball 610. In one implementation, cover panels 660 are formed from materials such as leather, synthetic leather, rubber and the like. In one implementation, the exterior surface of such cover panels 660 include a pebbled texture. Each cover panel 660 may additionally comprise the fabric backing coated with an adhesive prior to being secured to cover layer 28 which may also be alternatively coated with an adhesive. The basketball 710 can then be placed into a finishing mold to further secure the cover panels 660 and the strips 725 to the carcass 840. In some implementations, at least portions of one or more of cover panels 660 are translucent or transparent.

As shown by FIG. 11A, the basketball 710 formed by the method shown in FIGS. 12-28 has three layers, windings 26, the elastomeric layer 28 and cover panels 660, that extend about bladder 14 and about basketball 10, extending completely across mouth 36 of receptacle 18 and completely across electronics insert 20 which lies directly below windings 26 and elastomeric layer 28. In contrast to a distinct cap or cover along the outer surface of the basketball 10, windings 26, elastomeric layer 28 and outer cover panels 660 provide enhanced consistency and uniformity over mouth 36 and over electronics insert 20.

A basketball that incorporate electronics into an already molded carcass or a completed basketball has many drawback. Such constructions typically include a stand-alone plug that is inserted into the mouth of a receptacle on either the completed molded carcass or on the completed basketball. Since such plugs are positioned at or near the outer surface of the ball, the plugs negatively affect the rebound consistency of the basketball. The rebound height of such balls can be lower when bounced on or near the plug than when bounced at other locations about the ball. Further, overtime, the plug can loosen and project outward from the carcass or the cover panel, resulting in a high spot on the basketball. Such high spot or projection can cause premature wear and negatively affect the performance of the ball including bouncing, shooting and passing of the basketball. The loosened and/or outwardly projecting plug can allow any lubricant that may be used within the receptacle or housing to seep out of the receptacle further negatively affecting the playability of the basketball.

Basketballs produced in accordance with the implementation of the present invention avoid overcome these drawbacks, because windings 26 and elastomeric layer 28 continuously extend about basketball 10 while the same time continuously extending across electronics insert 20, resulting in more consistent and uniform bounce performance or bounce characteristics across its entire outer circumferential surface when different portions of the outer circumferential surface are undergoing impact. Outer cover panels 626 further enhances such bounce consistency. In particular, the bounce characteristics or rebound characteristics of basketball 10, when the exterior circumferential portion 56 of basketball 10 is directly impacting another surface, such as a blacktop, floor, backboard or rim, will be closer to the bounce characteristics or rebound characteristics of basketball 10 when other exterior circumferential portions of basketball 10, such as portions proximate valve 16, portions adjacent to logo or other exterior circumferential portions, are directly impacting the same surface.

Rebound Consistency Performance

Figure 29:
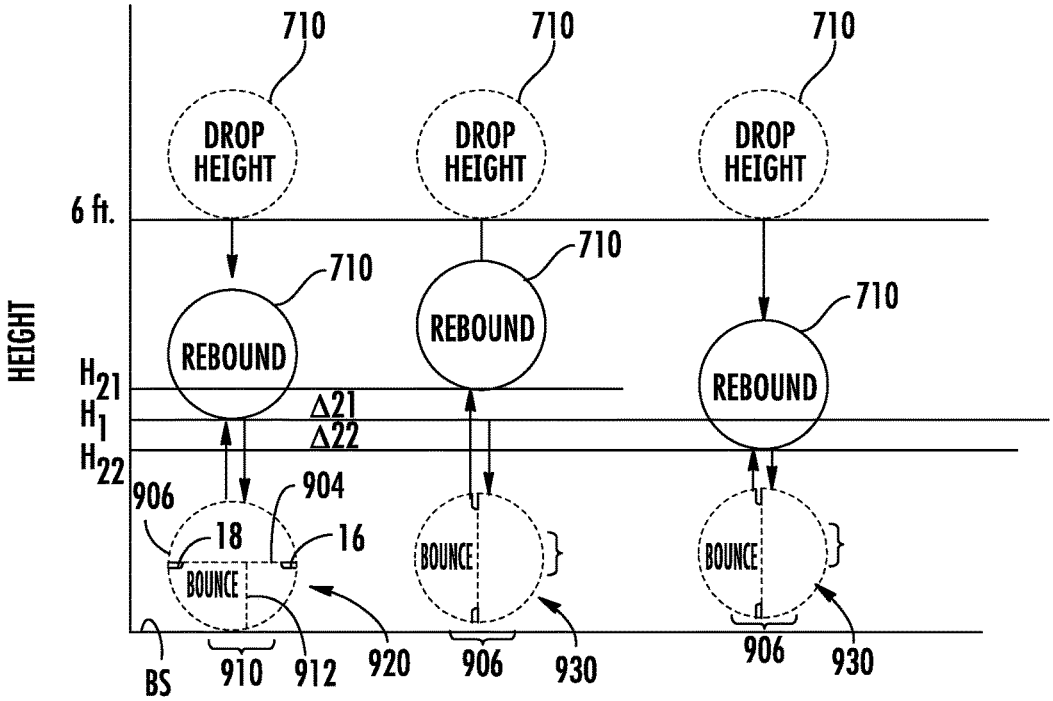
FIG. 29 is a diagram graphically illustrating a rebound comparison test for the basketball of FIG. 11.

FIG. 29 is a graph illustrating bounce consistency performance of basketball 710. Basketball 710 comprises a valve 16 which extends along an axis 904 through a center of basketball 710. Basketball 710 further comprises a receptacle, such as receptacle 18 (described above), carrying electronics, such as electronics insert 20 (described above). Basketball 710 has an outer circumferential surface region 906 that extends opposite to, proximate to and over receptacle 18. In one implementation, receptacle 18 is generally centered along the same axis along which valve 16 extends. As shown by FIG. 29, basketball 710 further comprises a second outer circumferential surface region 910 which is centered along a plane 912 that is perpendicular to the axis 904 and extends through the center of the basketball. In the example illustrated, outer circumferential surface regions 906 and 910 are angularly offset about basketball 710 by 90° along each of the two axes that extend perpendicular to one another through the center of the basketball.

In the example illustrated, outer circumferential surface region 910 is the outer portion of basketball 710 that is most representative of a substantial majority of the outer surface of basketball 710. Because outer circumferential surface region 910, amongst all the other regions of basketball 710, is farthest away from the extraneous supported structures of basketball 710, valve 16 and receptacle 18 (and electronics insert 20), surface region 910 is most likely to have bounce characteristics that differ from the bounce characteristics of region 906 by the largest extent. As a result, bounce uniformity or consistency may be most suitably measured by comparing bounce characteristics of regions 906 and 910, regions that are most likely to exhibit the greatest disparity amongst the different outer portions of basketball 710.

Bounce consistency or uniformity of basketball 710 may be determined by bouncing each of regions 906 and 910 upon a base or basketball surface BS. In one implementation, bounce consistency uniformity is determined based upon rebound characteristics of basketball 710 pursuant to Rule 1, Section 16, Article 7 of the 2014 & 2015 NCAA Men's Basketball Rules or Rule 1, Section 12, Article 2 of the NFHS Basketball Rules Book. As shown by FIG. 29, basketball 710 is dropped from a height of 6 feet above the base surface, as measured from a bottom of basketball 710. Basketball 710 is dropped from the six-foot height while in two different orientations: a first orientation 920 in which region 910 faces downward and is bounced against the base surface and a second orientation 930 in which region 906 faces downward and is bounced against the base surface BS.

As further shown by FIG. 29, the rebound height of basketball 710 (following the first "bounce") is measured with the basketball inflated at a pressure within the recommended inflation pressure range of the basketball. As shown by FIG. 29, when basketball 710 is dropped in the first orientation 920 such that region 910 impact the base surface, basketball 710 rebounds to a first height H1, as measured from a bottom of the basketball 710. When basketball 710 is dropped in the second orientation 930 such that region 906 impacts the base surface, basketball 710 rebounds to a second height at, above or below the first height H1. The magnitude of the difference between the first height and the second height, referred to as the delta between such heights, is measured and recorded. As shown by FIG. 29, basketball 710 may exhibit a delta 21 in which basketball 710, in orientation 930, rebounds to a height higher than when basketball 710 is dropped in orientation 920. Basketball 710 alternatively exhibits a delta 22 in which basketball 710, in orientation 930, rebounds to a height lesser than when basketball 710 is dropped in orientation 920.

To ensure consistency at different inflation levels of basketball 710, the above test is carried out at a plurality of different inflation pressures of basketball 710 within the recommended inflation range for basketball 710. In one implementation, the recommended inflation pressure for basketball 710 is provided in the packaging of basketball 710 and/or is stamped, embossed and/or printed upon basketball 710. In one implementation, basketball 710 has a recommended inflation pressure range of between 6 pounds per square inch (psi) and 8 psi. In one implementation, the aforementioned test is carried out with basketball 710 inflated to each of inflation pressures of 6 psi, 7 psi and 8 psi.

As described above, the overlapping of receptacle 18 with cover layer 28 and, in the tested example, windings 26 and outer panels 660, disperses or spreads out forces acting upon the point of impact of basketball 710 such that the bounce characteristics of basketball 710 when in orientation 930 more closely resemble the bounce characteristics of basketball 710 when in orientation 920. When basketball 710 is tested according to the above-described test, at each of a plurality of different inflation pressures, basketball 710 exhibits a rebound height delta (the absolute value difference between $H2_1$ or $H2_2$ and H1) that is no greater than 0.6 inches for a majority of the different inflation pressures.

In one test of example basketball 710, basketball 710 was inflated to each of inflation pressures 6 psi, 7 psi and 8 psi. For a majority of such different inflation pressures, the rebound height delta of basketball 710 at the respective inflation pressure did not exceed 0.5 inches. The rebound height delta of basketball 710 at the respective inflation pressures also did not exceed 0.6 psi. Below is Table 1 reflecting bounce uniformity or consistency of an example basketball 710. The basketball 710 used for Table 1 was formed with the electronics insert 20 inserted within the receptacle 18 before forming or molding of the bladder 814 and before the molding of the carcass. Similar testing was also performed upon basketball 740, where electronics insert 20 was inserted into receptacle 810 after molding of bladder 14 rather than before the molding of bladder 14, but before the molding of the elastomeric layer 28 to form the carcass. Table 1 compares the results of the testing of basketballs 710 and 740 with the results of the same test applied to an official Wilson® NCAA® Game Ball.

TABLE 1

REBOUND HEIGHT AND REBOUND DIFFERENTIAL

| | Inflation Pressure | | |
|---|---|---|---|
| | 6 psi | 7 psi | 8 psi |
| Basketball 710 at Orientation 920 Rebound Height (Inches) | 49.7 | 51.5 | 53.0 |
| Basketball 710 at Orientation 930 Rebound Height (Inches) | 50.0 | 51.5 | 52.9 |

TABLE 1-continued

| REBOUND HEIGHT AND REBOUND DIFFERENTIAL | Inflation Pressure | | |
|---|---|---|---|
| | 6 psi | 7 psi | 8 psi |
| Basketball 710: Rebound Height Delta (Inches) | 0.3 | 0.0 | 0.1 |
| Basketball 740 at Orientation 920 Rebound Height (Inches) | 50.0 | 52.4 | 53.2 |
| Basketball 740 at Orientation 930 Rebound Height (Inches) | 49.6 | 52.1 | 53.6 |
| Basketball 740 Rebound Height Delta (Inches) | 0.4 | 0.3 | 0.4 |
| Wilson ® NCAA ® Game Ball at Orientation 920 (Inches) | 51.0 | 53.5 | 53.5 |
| Wilson ® NCAA ® Game Ball at Orientation 930 (Inches) | 50.7 | 51.7 | 53.1 |
| Wilson ® NCAA ® Game Ball Rebound Height Delta (Inches) | 0.3 | 1.8 | 0.4 |

By way of contrast, as illustrated by Table 2 below, basketballs similar to basketball 710, but not having receptacle 18 overlapped by elastomeric layer 28 or windings 26, provided with a rubber cap or plug through an opening in the elastomeric layer 28, exhibited greater rebound height deltas across a majority of different recommended inflation pressures for the basketball. Such basketball had the electronics inserted into the ball after the molding of the bladder and after molding of the carcass.

TABLE 2

| REBOUND HEIGHT AND REBOUND DIFFERENTIAL | | | |
|---|---|---|---|
| INFLATION PRESSURE | REGION 910 (ORIENTATION 920) REBOUND HEIGHT | REGION 906 (ORIENTATION 930) REBOUND HEIGHT | REBOUND HEIGHT DELTA |
| 6 psi | 47.8 inches | 44.1 inches | 3.7 inches |
| 7 psi | 50.0 inches | 48.4 inches | 1.6 inches |
| 8 psi | 51.5 inches | 50.2 inches | 1.3 inches |

Table 3 below illustrates the results of the test measuring a stiffness of the basketball. The stiffness test identifies the amount of force needed to deflect the basketball at the sensor. The test was carried out by positioning the basketball in a universal testing machine, wherein the force is applied by a flat plate in contact with the surface of the basketball directly overlying the sensor and receptacle 18.

TABLE 3

| BASKETBALL STIFFNESS | Force Needed to Obtain Basketball Deflection of 1 cm at Inflation Pressure | | Force Needed to Obtain Basketball Deflection of 2 cm at Inflation Pressure | |
|---|---|---|---|---|
| | 7 psi | 8 psi | 7 psi | 8 psi |
| Basketball 710 at Orientation 920 Deformation (lbf) | 18.7 | 19.4 | 40.9 | 44.1 |
| Basketball 710 at Orientation 930 Deformation (lbf) | 18.8 | 19.8 | 41.7 | 45.0 |

TABLE 3-continued

| BASKETBALL STIFFNESS | Force Needed to Obtain Basketball Deflection of 1 cm at Inflation Pressure | | Force Needed to Obtain Basketball Deflection of 2 cm at Inflation Pressure | |
|---|---|---|---|---|
| | 7 psi | 8 psi | 7 psi | 8 psi |
| Basketball 740 at Orientation 920 Deformation (lbf) | 18.7 | 19.1 | 40.0 | 42.7 |
| Basketball 740 at Orientation 930 Deformation (lbf) | 18.9 | 19.8 | 41.0 | 44.2 |
| Wilson ® NCAA ® Game Ball at Orientation 920 Deformation (lbf) | 18.1 | 18.9 | 41.8 | 44.9 |
| Wilson ® NCAA ® Game Ball at Orientation 930 Deformation (lbf) | 18.5 | 19.1 | 42.2 | 45.3 |

As illustrated in Table 3 above, each of basketballs 710 and 740, inflated to 7 psi, required 19 lbf or less force to deflect 1 cm, very similar to the 18.1 lbf to deflect the Wilson® NCAA® Game Ball at the sensor when inflated to the same 7 psi. As further illustrated in Table 3 above, each of basketballs 710 and 740, inflated to 8 psi, required 20 lbf or less force to deflect 1 cm, very similar to the 19.1 lbf to deflect the Wilson® NCAA® Game Ball at the sensor when inflated to the same 8 psi.

As further illustrated in Table 3 above, the amount of force required to deflect the basketball is substantially similar regardless of what part of the basketball is undergoing compression or deflection. Each of basketballs 710 and 740, inflated to 7 psi, required a first amount of force to deflect the basketball 1 cm in orientation 920 and a second amount of force to deflect the basketball 1 cm in orientation 930, wherein the first and second amount of force where no greater than 0.4 lbf of one another. Each of basketballs 710 and 740, inflated to 7 psi, required a first amount of force to deflect the basketball 2 cm in orientation 920 and a second amount of force to deflect the basketball 2 cm in orientation 930, wherein the first and second amounts of force were no greater than 1.0 lbf of one another.

Each of basketballs 710 and 740, inflated to 8 psi, required a first amount of force to deflect the basketball 1 cm in orientation 920 and a second amount of force to deflect the basketball 1 cm in orientation 930, wherein the first and second amount of force were no greater than 0.7 lbf of one another. Each of basketballs 710 and 740, inflated to 8 psi, required a first amount of force to deflect the basketball 2 cm in orientation 920 and a second amount of force to deflect the basketball 1 cm in orientation 930, wherein the first and second amounts of force where no greater than 1.5 lbf of one another.

Figure 30:
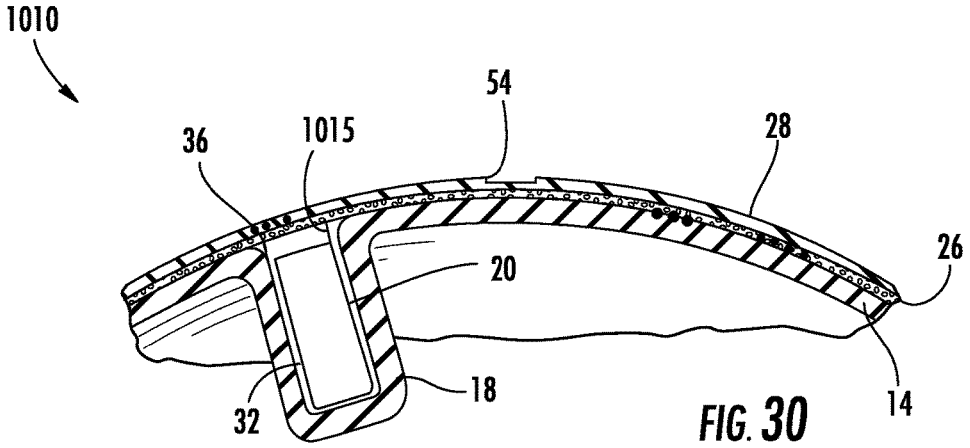
FIG. 30 is a fragmentary sectional view of another example basketball.
Figure 31:
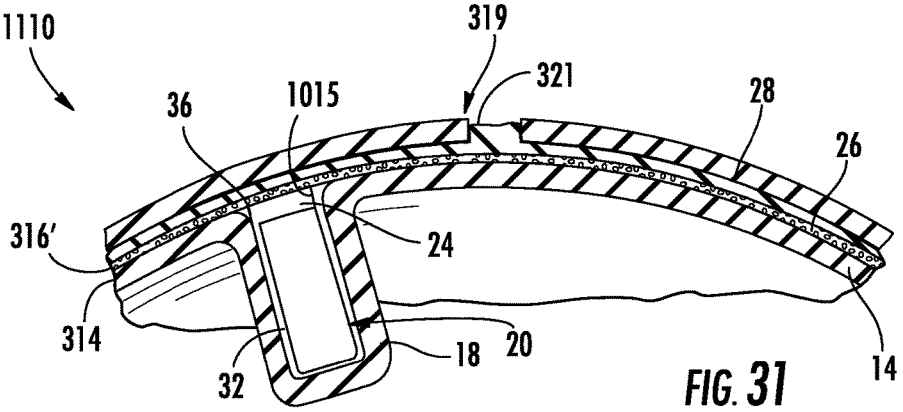
FIG. 31 is a fragmentary sectional view of another example basketball.
Figure 32:
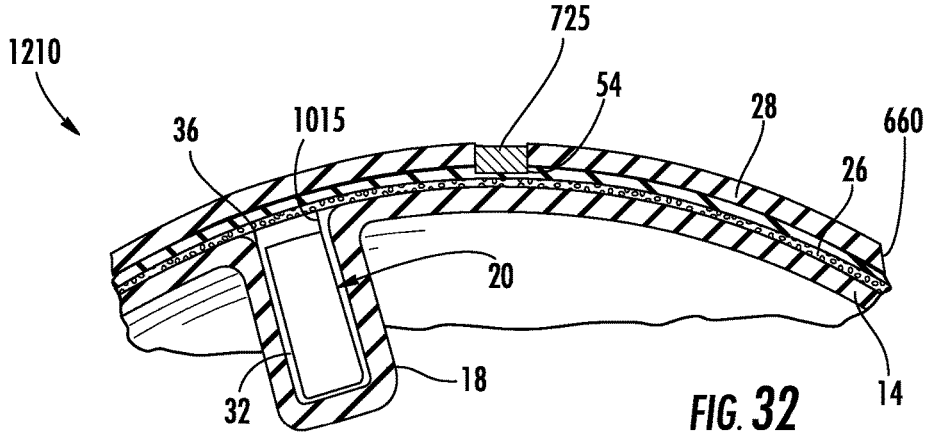
FIG. 32 is a fragmentary sectional view of another example basketball.

FIGS. 30-32 illustrate basketballs 1010, 1110 and 1210, alternative implementations of basketballs 10, 610 and 710, respectively. Basketballs 1010, 1110 and 1210 are similar to basketballs 10, 610 and 710, respectively, except that in each of basketballs 1010, 1110 and 1210, windings 26 having opening 1015 opposite to mouth 36 and in communication with the interior cavity 32 of receptacle 18. Those remaining components or structures of basketballs 1010, 1110 and 1210 that correspond to components or structures of basketballs 10, 610 and 710, respectively, are numbered similarly.

Opening 1015 facilitates insertion or positioning of electronics insert 20 and optional plug 24 into receptacle 18 after bladder 14 has been wound with windings 26, prior to the forming and molding of elastomeric layer 28 to form the carcass. In one implementation, during winding of the bladder, the filaments about bladder 14 are configured to not cover portions of bladder 14 opposite to mouth 36, leaving a gap which serves as opening 1015. In another implementation, the programming of the winding machine is configured to provide a much lower density of filaments are windings across mouth 36, allowing electronics insert 20 to be pushed through the lower density of windings or allowing the lower density of windings to be pushed aside or severed for insertion of electronics insert 20.

Figure 33:
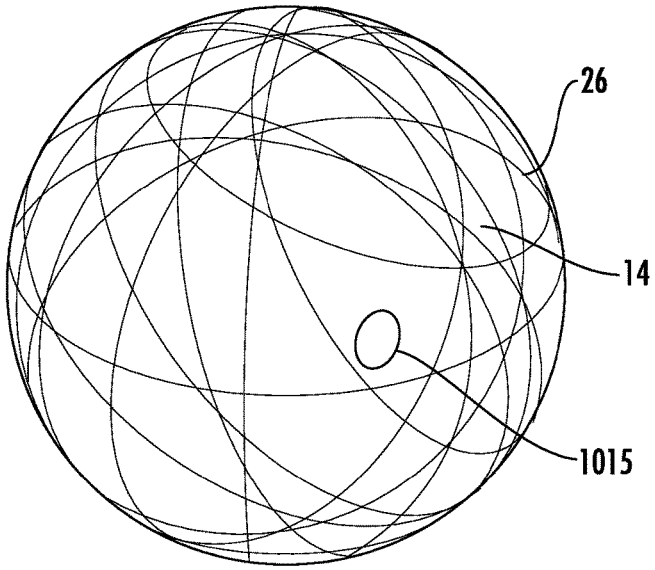
FIG. 33 is a perspective view illustrating the application of windings about a bladder to form a wound bladder for any of the basketballs of FIGS. 30-32.
Figure 34:
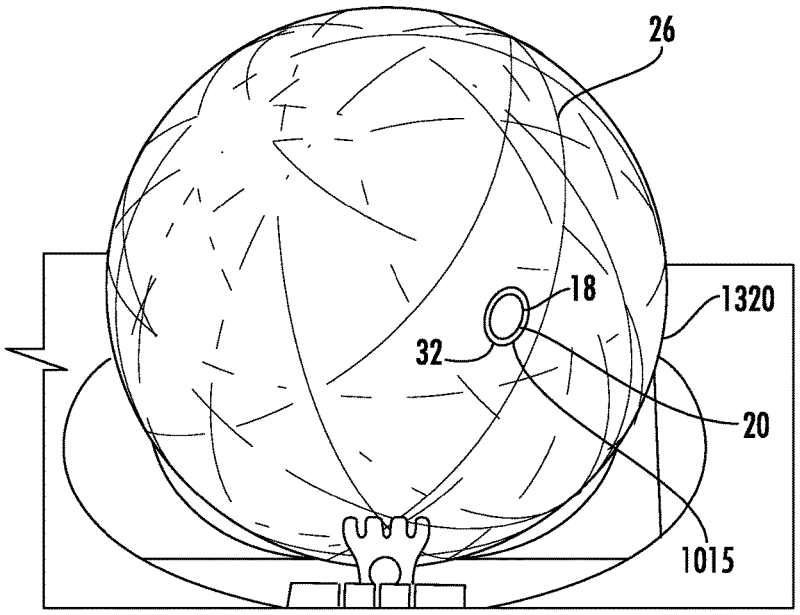
FIG. 34 is a perspective view illustrating an example completed wound bladder into which an example electronics insert is positioned.

FIG. 33 illustrates the winding of bladder 14 so as to form opening 1015 through windings 26. FIG. 34 illustrates the wound bladder 1320, similar to wound bladder 820 in FIG. 21, except that wound bladder 1320 comprises opening 1015. In one implementation, windings 26 are formed about bladder 14 while receptacle 18 is empty, not containing electronics insert 20. As shown by FIG. 34, opening 1015 facilitates insertion of electronics insert 20 through opening 1015 into the cavity 32 of receptacle 18 after or during the application of windings 26 to form wound bladder 1320. As described above, in some implementations, plug 24 may be additionally inserted through opening 1015 on top of electronics insert 20. Basketball 1010 is formed by subtly carrying out the steps illustrated in FIGS. 22-26. As noted above, in some implementations, such steps may additionally include forming or molding dimples on the exterior surface of elastomeric layer 28. Basketball 1110 is formed by subsequently carrying out the steps shown in FIGS. 23-26 and 28, wherein dividers 321 are formed on the outer surface of carcass 840. Basketball 1210 is formed by subsequently carrying out the steps shown in FIGS. 22-28.

As shown by FIGS. 30-32, in each of basketballs 1010, 1110 and 1210, comprise an elastomeric layer 28 that continuously extends about the wound bladder 14, continuously extending over and across mouth 36 of receptacle 18 and over opening 1015 to enhance bounce consistency. Basketballs 1110 and 1210 additionally comprise cover panels 660 that span mouth 36 over and across opening 1015 for further shielding of opening 1015 and mouth 36 for enhanced bounce consistency.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A basketball comprising:

a bladder;

a receptacle projecting inward from the bladder proximate an outer portion of the bladder;

electronics positioned within the receptacle;

windings positioned over the bladder, the windings comprising a reinforcing thread formed from an elastomeric material comprising at least one of a nylon based material or a urethane based material;

a molded elastomeric layer extending over the bladder and the electronics, wherein the windings extend over the electronics, and are sandwiched between the electronics and the molded elastomeric layer;

a valve extending along an axis;

a first outer surface opposite the valve and overlying the receptacle; and a second outer surface aligned with a plane perpendicular to the axis through a center of the basketball;

wherein the basketball when inflated to an air pressure within a recommended inflation range for the basketball, and is dropped from 6 feet above a base surface, as measured from a bottom of the basketball, rebounds to a first height, when measured from the bottom of the basketball, when the first outer surface is bounced upon the base surface, and a second height, as measured from the bottom of the basketball, when the second outer surface is bounced upon the base surface; and wherein the first height and the second height have a delta of no greater than 0.5 inches at an air pressure within a recommended inflation range for the basketball.

2. The basketball of claim 1, wherein the bladder has a bladder wall having a spherical shape and wherein the receptacle has a mouth and the receptacle projects inward from the bladder wall into the interior of the bladder, and wherein the electronics are contained within the receptacle.

3. The basketball of claim 2, wherein the windings extend over the mouth to cover the mouth.

4. The basketball of claim 3 further comprising a plug closing the mouth, wherein the windings extend over the plug to cover the plug.

5. The basketball of claim 2, further including a plug positioned within the receptacle retaining the electronics within the receptacle.

6. The basketball of claim 5, wherein the plug is fused to at least one of the bladder and the receptacle.

7. The basketball of claim 1 further comprising cover panels formed over the molded elastomeric layer.

8. The basketball of claim 1, wherein the recommended air pressures for the basketball comprise at one of 6 pounds per square inch (psi), 7 psi and 8 psi.

9. The basketball of claim 1, wherein the basketball, when inflated to 7 psi, requires 19 lbf or less force to deflect 1 cm at a location on the basketball opposite the electronics.

10. The basketball of claim 1, wherein the basketball, when inflated to 8 psi, requires 20 lbf or less force to deflect 1 cm at a location on the basketball opposite the electronics.

11. The basketball of claim 1, wherein the molded elastomeric layer continuously extends 360° about the basketball, completely covering an entirety of the outer circumferential surface of the bladder.

12. The basketball of claim 1, wherein the windings continuously extend 360° about the basketball, completely covering an entirety of the outer circumferential surface of the bladder.

13. The basketball of claim 1 further comprising a rechargeable battery positioned radially inward of the electronics and the windings.

14. The basketball of claim 1, wherein the windings form a windings layer having a top surface contacting the molded elastomeric layer and a bottom surface, a portion of which is contacting the bladder and wherein the electronics are sandwiched between the bottom surface and the bladder.

15. A basketball comprising:

a bladder;

a receptacle projecting inward from the bladder proximate an outer portion of the bladder;

electronics positioned within the receptacle;

windings positioned over the bladder, the windings comprising a reinforcing thread formed from an elastomeric material comprising at least one of a nylon based material or a urethane based material;

a molded elastomeric layer extending over the bladder and the electronics, wherein the windings extend over the electronics, and are sandwiched between the electronics and the molded elastomeric layer;

a valve extending along a first axis;

a first outer surface opposite the valve and overlying the receptacle; and a second outer surface aligned with a second axis extending within a plane perpendicular to the first axis through a center of the basketball;

wherein the basketball when inflated 7 psi and when compressed in a direction along the first axis requires a first amount of force to deflect the basketball 1 cm, wherein the basketball when inflated 7 psi and when compressed in a direction along the second axis requires a second amount of force to deflect the basketball 1 cm and wherein the first force and the second force are no greater than 0.4 lbf of one another.

16. A basketball comprising:

a bladder;

a receptacle projecting inward from the bladder proximate an outer portion of the bladder;

electronics positioned within the receptacle;

windings positioned over the bladder, the windings comprising a reinforcing thread formed from an elastomeric material comprising at least one of a nylon based material or a urethane based material;

a molded elastomeric layer extending over the bladder and the electronics, wherein the windings extend over the electronics, and are sandwiched between the electronics and the molded elastomeric layer;

a valve extending along a first axis;

a first outer surface opposite the valve and overlying the receptacle; and a second outer surface aligned with a second axis extending within a plane perpendicular to the first axis through a center of the basketball;

wherein the basketball when inflated 7 psi and when compressed in a direction along the first axis requires a first amount of force to deflect the basketball 2 cm, wherein the basketball when inflated 7 psi and when compressed in a direction along the second axis requires a second amount of force to deflect the basketball 2 cm and wherein the first force and the second force are no greater than 1.0 lbf of one another.

17. A basketball comprising:

a bladder;

a receptacle projecting inward from the bladder proximate an outer portion of the bladder;

electronics positioned within the receptacle;

windings positioned over the bladder, the windings comprising a reinforcing thread formed from an elastomeric material comprising at least one of a nylon based material or a urethane based material;

a molded elastomeric layer extending over the bladder and the electronics, wherein the windings extend over the electronics, and are sandwiched between the electronics and the molded elastomeric layer;

a valve extending along a first axis;

a first outer surface opposite the valve and overlying the receptacle; and a second outer surface aligned with a second axis extending within a plane perpendicular to the first axis through a center of the basketball;

wherein the basketball when inflated 8 psi and when compressed in a direction along the first axis requires a first amount of force to deflect the basketball 1 cm, wherein the basketball when inflated 8 psi and when compressed in a direction along the second axis requires a second amount of force to deflect the basketball 1 cm and wherein the first force and the second force are no greater than 0.7 lbf of one another.

18. A basketball comprising:

a bladder;

a receptacle projecting inward from the bladder proximate an outer portion of the bladder;

electronics positioned within the receptacle;

windings positioned over the bladder, the windings comprising a reinforcing thread formed from an elastomeric material comprising at least one of a nylon based material or a urethane based material;

a molded elastomeric layer extending over the bladder and the electronics, wherein the windings extend over the electronics, and are sandwiched between the electronics and the molded elastomeric layer;

a valve extending along a first axis;

a first outer surface opposite the valve and overlying the receptacle; and a second outer surface aligned with a second axis extending within a plane perpendicular to the first axis through a center of the basketball;

wherein the basketball when inflated 8 psi and when compressed in a direction along the first axis requires a first amount of force to deflect the basketball 2 cm, wherein the basketball when inflated 8 psi and when compressed in a direction along the second axis requires a second amount of force to deflect the basketball 2 cm and wherein the first force and the second force are no greater than 1.5 lbf of one another.

19. A method for forming a basketball, the method comprising:

attaching electronics to a bladder wall forming an inflatable sphere;

forming an elastomeric layer over the bladder wall and the electronics;

molding the elastomeric layer while the electronics are attached to the bladder, wherein the bladder has a bladder wall having a spherical shape and wherein the basketball further comprises a receptacle having a mouth and the receptacle projecting inward from the bladder wall in to the interior of the bladder, and wherein the electronics are contained within the receptacle, the method further comprising:

inserting the electronics through the opening into the receptacle, wherein the elastomeric layer is formed and molded across and over the opening while the electronics are contained within the receptacle.

20. The method of claim 19 further comprising applying cover panels over the elastomeric layer, at least one of the cover panels extending over a portion of the elastomeric layer that extends over the mouth of the receptacle.

21. The method of claim 19 further comprising molding the inflatable sphere of the bladder while the electronics are within the receptacle.

22. The method of claim 19, wherein the receptacle has a mouth along the surface of the inflatable sphere, the method further comprising closing the mouth with a plug across the mouth with the electronics within the receptacle, wherein the elastomeric layer is formed across the plug.

23. The method of claim 19 further comprising applying windings over the inflatable sphere, leaving an opening in communication with the receptacle, wherein the elastomeric layer is formed and molded over the windings and over the opening while the electronics are contained within the receptacle.

24. The method of claim 19 further comprising applying windings over the inflatable sphere, wherein the elastomeric layer is formed and molded over the windings while the electronics are contained within the receptacle and while the windings extend over the electronics so as to be sandwiched between the electronics and the molded elastomeric layer.

25. The method of claim 19 further comprising molding the bladder, wherein the molding of the bladder occurs while the electronics are contained within the receptacle.

* * * * *